US006526378B1

(12) United States Patent
Tasaki

(10) Patent No.: US 6,526,378 B1
(45) Date of Patent: Feb. 25, 2003

(54) METHOD AND APPARATUS FOR PROCESSING SOUND SIGNAL

(75) Inventor: Hirohisa Tasaki, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/568,127

(22) Filed: May 10, 2000

Related U.S. Application Data

(63) Continuation of application No. PCT/JP98/05514, filed on Dec. 7, 1998.

(30) Foreign Application Priority Data

Dec. 8, 1997 (JP) ..... 9-336803

(51) Int. Cl.[7] ..... G10L 19/04

(52) U.S. Cl. ..... 704/224; 704/230; 704/225; 704/244; 704/205

(58) Field of Search ..... 704/200.1, 224, 704/230, 232, 219, 206, 220, 262, 231, 500, 501, 225, 244, 258

(56) References Cited

U.S. PATENT DOCUMENTS

| | | | | | |
|---|---|---|---|---|---|
| 4,933,973 | A | * | 6/1990 | Porter | 704/226 |
| 4,937,873 | A | * | 6/1990 | McAulay et al. | 704/265 |
| 5,012,519 | A | * | 4/1991 | Adlersberg et al. | 704/226 |
| 5,276,765 | A | * | 1/1994 | Freeman et al. | 704/233 |
| 5,701,390 | A | * | 12/1997 | Griffin et al. | 704/206 |
| 5,774,835 | A | | 6/1998 | Ozawa | |
| 5,870,405 | A | * | 2/1999 | Hardwick et al. | 714/701 |
| 6,092,039 | A | * | 7/2000 | Zingher | 704/221 |
| 6,131,084 | A | * | 10/2000 | Hardwick | 704/230 |
| 6,167,375 | A | * | 12/2000 | Miseki et al. | 704/229 |

FOREIGN PATENT DOCUMENTS

| | | |
|---|---|---|
| JP | A57184332 | 11/1982 |
| JP | A61123898 | 6/1986 |
| JP | 6424572 | 1/1989 |
| JP | A1251000 | 10/1989 |
| JP | A7248793 | 9/1995 |
| JP | A8130513 | 5/1996 |
| JP | A8154179 | 6/1996 |
| JP | A1049197 | 2/1998 |
| JP | A10171497 | 6/1998 |
| JP | A10254499 | 9/1998 |

OTHER PUBLICATIONS

Boll, IEEE, vol. 27, No. 2, pp. 113–120 (1979).

* cited by examiner

*Primary Examiner*—Vijay Chawan
(74) *Attorney, Agent, or Firm*—Birch, Stewart, Kolasch & Birch, LLP

(57) ABSTRACT

A method and an apparatus for processing a sound signal are provided, which process an input sound signal including degraded sound such as quantization noise so as to make the degraded sound subjectively unperceptible.

A transformation strength controller calculates a spectrum of a decoded speech after perceptually weighting the decoded speech as the input sound signal, and calculates transformation strength based on the extent of the amplitude and the continuity of the spectrum. A signal transformer obtains a spectrum of the decoded speech, smoothes the amplitude and disturbs the phase based on the transformation strength, and the obtained signal is returned back to a signal region as a transformed decoded speech. A signal evaluator obtains background noise likeness by analyzing the decoded speech and the obtained value is made to be an addition control value. In the weighted value adder, when the addition control value appears to be the background noise likeness, the weight for adding to the decoded speech is reduced, the weight for adding to the transformed decoded speech is increased, and an output speech is obtained.

20 Claims, 12 Drawing Sheets

METHOD AND APPARATUS FOR PROCESSING SOUND SIGNAL

This application is a continuation of PCT/JP98/05514 filed Dec. 7, 1998.

TECHNICAL FIELD

This invention relates to a method and an apparatus for processing a sound signal such as speech or music, which processes the signal so that subjectively bad component included in the sound signal such as quantization noise generated in encoding/decoding process, or sound distortion made by various signal processing such as noise suppression is made subjectively unperceptible.

BACKGROUND ART

The more compressibility is increased in encoding information source such as speech or music, the more quantization noise is generated as a distortion made in the encoding process. Furthermore, the quantization noise becomes warped to cause the reproduced sound to be subjectively unbearable. For example, in case of speech encoding method faithfully expressing a speech signal itself such as PCM (Pulse Code Modulation) and ADPCM (Adaptive Differential Pulse Code Modulation), the quantization noise appears at random and the reproduced sound including such a noise is not so subjectively unpleasant. However, as the compressibility is increased and the encoding method becomes more complex, sometimes there appear a certain spectral characteristic peculiar to the encoding method in the quantization noise, which causes the reproduced sound to become subjectively degraded:. Especially, within a signal period where background noise is dominant, a speech model utilized by the speech encoding method with high compressibility does not match, thus the reproduced sound becomes extremely unpleasant sound.

In another case, on performing a noise suppression such as a spectral subtraction method, there remains an estimated error of noise as a damage in the processed signal. This estimated error has a characteristic being much different from the original signal, which may damage subjective evaluation of the reproduced sound.

Conventional methods to suppress the degradation of the subjective evaluation of the reproduced sound due to the quantization noise or distortion are disclosed in Japanese Unexamined Patent Publications No. HEI 8-130513, No. HEI 8-146998, No. HEI 7-160296, HEI 6-326670, HEI 7-248793, and S. F. Boll, "raction SSP-27, No. 2, pp. 113–120, April 1979) (this document is referred to as "document 1", hereinafter).

Japanese Unexamined Patent Publication No. HEI 8-130513 aims to improve the quality of the reproduced sound within the background noise period. It is checked whether the period includes only background noise or not. When it is detected to be the period including only background noise, a sound signal is encoded/decoded in an exclusive way to such a period. On decoding the encoded signal within the period including only background noise, the characteristics of a synthetic filter is controlled so as to obtain the perceptually natural reproduced sound.

In Japanese Unexamined Patent Publication No. HEI 8-146998, white noise or previously stored background noise is added to the decoded speech so as to prevent the white noise from turning into harsh grating noise in the reproduced sound due to encoding or decoding.

Japanese Unexamined Patent Publication No. HEI 7-160296 aims to perceptually reduce the quantization noise by postfiltering using a coefficient, which is a filtering coefficient obtained based on an perceptually masking threshold value corresponding to a decoded speech or an index concerning a spectral parameter received by a speech decoding unit.

In a conventional code transmission system where the transmission of the code is suspended during non-speech period for controlling communication power, the decoding side generates and outputs pseudo background noise when the code transmission is suspended. Japanese Unexamined Patent Publication No. HEI 6-326670 aims to reduce an incongruity between an actual background noise included in the speech period and the pseudo background noise generated for the non-speech period. In this method, the pseudo background noise is overlaid onto the sound signal of the speech period as well as the non-speech period.

Japanese Unexamined Patent Publication No. HEI 7-248793 aims to perceptually reduce the distortion sound generated by the noise suppression. First, the encoding side checks whether it is the noise period or the speech period. In the noise period, the noise spectrum is transmitted. In the speech period, the spectrum of speech, in which noise has been suppressed is transmitted. The decoding side generates and outputs a synthetic sound using the received noise spectrum in the noise period. In the speech period, the synthetic sound generated using the received spectrum of speech, in which noise has been suppressed is added to a result of multiplication of the synthetic sound generated using the noise spectrum received in the noise period and overlaying multiplying factor, and the added result is output.

Document 1 aims to perceptually reduce the distortion sound due to the noise suppression by smoothing the amplitude spectrum of the output speech, in which noise has been suppressed with the previous/subsequent period, and further, by suppressing the amplitude only in the background noise period.

As for the above conventional methods, the following problems are to be solved.

In Japanese Unexamined Patent Publication No. HEI 8-130513, there is a problem that a sudden change of the characteristic may happen at a border between the noise period and the speech period because encoding and decoding are completely switched based on the period check result. In particular, if it frequently happens that the noise period is misjudged to be a speech period, the reproduced sound of the noise period, which is to be relatively stable in general, unsteadily changes. This may cause degradation of the reproduced sound of the noise period. When the check result of the noise period is transmitted, information for transmission is required to be added. This information may be mistook on the channel, which may cause another problem, that is, unnecessary degradation. Further, there is another problem that an effective improvement cannot be brought to the reproduced sound in case of specific kind of noise because it is impossible to reduce the quantization noise generated by encoding the sound source only by controlling the characteristic of a synthetic filter.

Japanese Unexamined Patent Publication No. HEI 8-146998 has a problem that a characteristic of the present encoded background noise may lose because a prepared noise is added. In order to make a degraded sound unperceptible, it is required to add a noise with higher level than the degraded sound. This causes another problem that the reproduced background noise becomes loud.

In Japanese Unexamined Patent Publication No. HEI 7-160296, an perceptually masking threshold value is obtained based on a spectral parameter, and a spectral postfiltering is performed based on this threshold value. There is a problem that in case of a background noise with relatively flat spectrum, few components are masked, which may cause no effect to the reproduced sound. Unmasked main component is not much changed, thus there is another problem that a distortion included in the main component may remain unchanged.

In Japanese Unexamined Patent Publication No. HEI 6-326670, pseudo background noise is generated regardless of the actual background noise, which causes a problem that a characteristic of the actual background noise may lose.

In Japanese Unexamined Patent Publication No. HEI 7-248793, encoding and decoding is completely switched according to the period check result, so that when the period is mistook between the noise period and the speech period, the reproduced sound may much degraded. Namely, when a part of the noise period is mistook as the speech period, the quality of the reproduced sound within the noise period discontinuously varies and the reproduced sound becomes unpleasant to hear. On the contrary, when the speech period is mistook as the noise period, the quality of the reproduced sound is generally degraded because speech component may be inserted in the synthetic sound of the noise period generated using a mean noise spectrum and the synthetic sound of the speech period generated using the noise spectrum to be overlaid. Further, in order to make the degraded sound unperceptible within the speech period, a noise with not a low level is required to be overlaid.

In the method according to Document 1, there is a problem that processing delay of half period (about 10 ms–20 ms) may occur because of smoothing process. When a part of the noise period is mistook as the speech period, the quality of the reproduced sound within the noise period discontinuously varies and the reproduced sound becomes unpleasant to hear.

The present invention aims to solve the above problems. It is an object of the invention to provide a method and an apparatus for processing a sound signal, in which the reproduced sound is not much degraded because of mistake of the period check, the dependency on a kind of noise or a spectral shape is small, much delay time is not needed, it is possible to remain a characteristic of the actual background noise, it is not required to increase the background noise level too much, a new information for transmission is not required to be added, and the degraded component caused by encoding the sound source can be efficiently suppressed.

DISCLOSURE OF THE INVENTION

A method for processing a sound signal includes generating a first processed signal by processing an input sound signal, calculating a predetermined evaluation value by analyzing the input sound signal, operating a weighted addition of the input sound signal and the first processed signal based on the predetermined evaluation value to generate a second processed signal, and outputting the second processed signal.

In the above method for generating a first processed signal, the step of generating the first processed signal further includes calculating a spectral component for each frequency by performing a Fourier transformation on the input sound signal, performing a predetermined transformation on the spectral component for each frequency calculated by performing the Fourier transformation, and generating the spectral component after the predetermined transformation by operating an inverse Fourier transformation.

Further, in the above method, the weighted addition is operated in a spectral region.

Further, in the above method, the weighted addition is controlled respectively for each frequency component.

Further, in the above method, the predetermined transformation on the spectral component for each frequency includes a smoothing process of an amplitude spectral component.

Further, in the above method, the predetermined transformation on the spectral component for each frequency includes a disturbing process of a phase spectral component.

Further, in the above method, the smoothing process controls smoothing strength based on an extent of the amplitude spectral component of the input sound signal.

Further, in the above method, the disturbing process controls disturbing strength based on an extent of an amplitude spectral component of the input sound signal.

Further, in the above method, the smoothing process controls smoothing strength based on an extent of time-based continuity of the spectral component of,the input sound signal.

Further, in the above method, the disturbing process controls disturbing strength based on an extent of time-based continuity of the spectral component of the input sound signal.

Further, in the above method, a perceptually weighted input sound signal is used for the input sound signal.

Further, in the above method, the smoothing process controls smoothing strength based on an extent of variability in time of the evaluation value.

Further, in the above method, the disturbing process controls disturbing strength based on an extent of variability in time of the evaluation value.

Further, in the above method, an extent of a background noise likeness calculated by analyzing the input sound signal is used for the predetermined evaluation value.

Further, in the above method, an extent of a frictional noise likeness calculated by analyzing the input sound signal is used for the predetermined evaluation value.

Further, in the above method, a decoded speech decoded from a speech code generated by a speech encoding process is used for the input sound signal.

According to the present invention, a method for processing a sound signal includes decoding the speech code generated by the speech encoding process as the input sound signal to obtain a first decoded speech, generating a second decoded speech by postfiltering the first decoded speech, generating a first processed speech by processing the first decoded speech, calculating a predetermined evaluation value by analyzing any of the decoded speeches, operating weighted addition of the second decoded speech and the first processed speech based on the evaluation value to obtain a second processed speech, and outputting the second processed speech as an output speech.

According to the present invention, an apparatus for processing a sound signal includes a first processed signal generator processing an input sound signal to generate a first processed signal, an evaluation value calculator calculating a predetermined evaluation value by analyzing the input sound signal, a second processed signal generator operating a weighted addition of the input sound signal and the first processed signal based on the evaluation value calculated by the evaluation value calculator and outputting a result of the weighted addition as a second processed signal.

Further, in the above apparatus, the first processed signal generator calculates a spectral component for each frequency by operating a Fourier transformation of the input sound signal, smoothes an amplitude spectral component included in the spectral component calculated for each frequency, and generates the first processed signal by operating an inverse Fourier transformation of the spectral component after smoothing the amplitude spectral component.

Further, in the above apparatus, the first processed signal generator calculates a spectral component for each frequency by operating a Fourier transformation of the input sound signal, disturbs a phase spectral component included in the spectral component calculated for each frequency, and generates the first processed signal by operating an inverse Fourier transformation of the spectral component after disturbing the phase spectral component.

BEST MODE FOR CARRYING OUT THE INVENTION

Figure 1:
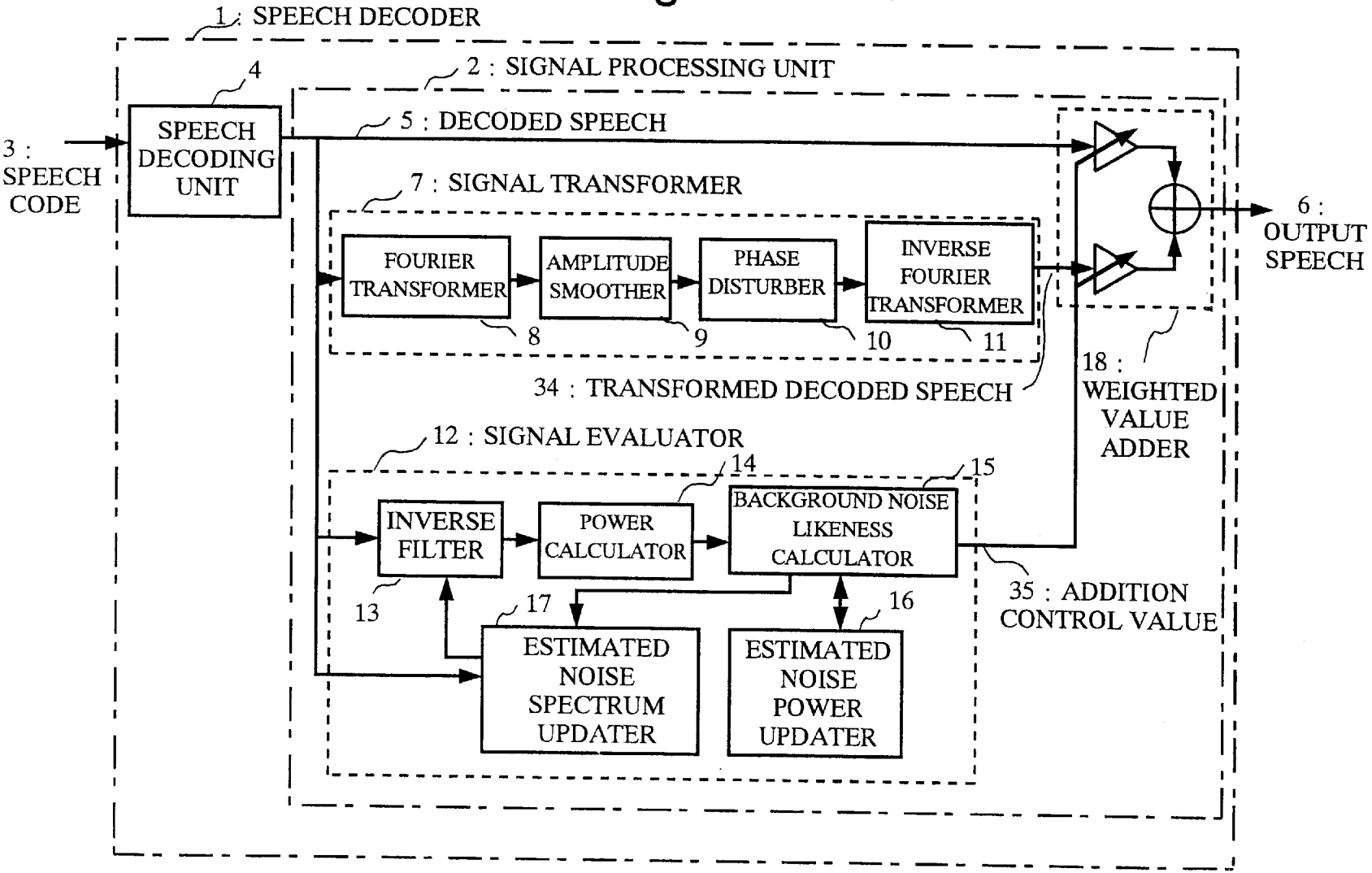
FIG. 1 shows a general configuration of a speech decoding apparatus applying a speech decoding method according to a first embodiment of the present invention.

Hereinafter, some embodiments of the present invention will be explained referring to the drawings.

Embodiment 1

FIG. 1 shows a general configuration of a speech decoding method applying a speech signal processing method according to the embodiment. In the figure, a reference numeral 1 shows a speech decoder, 2 shows a signal processing unit performing the signal processing method of the invention, 3 shows a speech code, 4 shows a speech decoding unit, 5 is a decoded speech, and 6 is an output speech. The signal processing unit 2 is configured by a signal transformer 7, a signal evaluator 12, and a weighted value adder 18. The signal transformer 7 includes a Fourier transformer 8, an amplitude smoother 9, a phase disturber 10, and an inverse Fourier transformer 11. The signal evaluator 12 includes an inverse filter 13, a power calculator 14, a background noise likeness calculator 15, an estimated background noise power updater 16, and an estimated noise spectrum updater 17.

An operation will be explained referring to the figure.

First, the speech code 3 is input to the speech decoding unit 4 of the speech decoder 1. The speech code 3 has been output as an encoded result of a speech signal by a speech encoding unit, which is not shown in the figure. The speech code 3 is input to the speech decoding unit 4 through a channel or a storage device.

The speech decoding unit 4 performs decoding process, which corresponds to the encoding process of the above speech encoding unit, on the speech code 3 and a signal having a predetermined length (1 frame length) obtained is output as the decoded speech 5. The decoded speech 5 is input to each of the signal transformer 7, the signal evaluator 12, and the weighted value adder 18 of the signal processing unit 2.

The Fourier transformer 8 of the signal transformer 7 multiplies a predetermined window to a signal composing the decoded speech 5 input to the present frame and optionally a newest part of the decoded speech 5 of the previous frame. The Fourier transformation is operated on the windowed signal to obtain a spectral component for each frequency and the obtained result is output to the amplitude smoother 9. As for Fourier transformation, discrete Fourier transformation (DFT), fast Fourier transformation (FFT) are most popular. Various kinds of windowing can be used such as a trapezoidal window, a: rectangular window, and a Hanning window. In this embodiment, a transformed trapezoidal window is used, which is made by replacing slanted parts of both sides of the trapezoidal window with halves of the Hanning window. Examples of actual shapes of the windows and timing relationship with the decoded speech 5 and the output speech 6 will be described later referring to the drawings.

The amplitude smoother 9 smoothes the amplitude component of the spectrum for each frequency supplied from the Fourier transformer 8, and the smoothed spectrum is output to the phase disturber 10. As for smoothing process, smoothing both in a frequency-based direction and in a time-based direction are effective to suppress the degraded sound such as quantization noise. However, when smoothing in a frequency-based direction is strongly performed, a laziness occurs in the spectrum, which may often damage a characteristic of the substantive background noise. On the other hand, when smoothing in a time-based direction is strongly performed, the same sound remains for a long time, which may create a sense of reverberation. Through investigation of smoothing various kinds of background noise, the best quality of the output speech 6 is obtained by a case that a amplitude is smoothed within a logarithmic region in the time-based direction and smoothing is not performed in the frequency-based direction. The following expression represents the above smoothing method.

$$y_i = y_{i-1}(1-\alpha) + x_i\alpha \quad \text{expression 1}$$

where, $x_i$ represents a logarithmic amplitude spectrum value of the present frame (i-th frame) before smoothing, $y_{i-1}$ represents a logarithmic amplitude spectrum value of the previous frame ((i−1)-th frame) after smoothing, $y_i$ represents a logarithmic amplitude spectrum value of the present frame (i-th frame) after smoothing, and $\alpha$ represents a smoothing coefficient having a value of 0 through 1. The optimal value of the smoothing coefficient $\alpha$ varies according to a frame length, a level of the degraded sound to be dissolved and so on. The value of around 0.5 is generally used as the optimal value.

The phase disturber 10 disturbs the phase component of the spectrum after smoothing supplied from the amplitude smoother 9, and the disturbed spectrum is output to the inverse Fourier transformer 11. As for a method for disturbing each phase component, a phase angle is generated using a random number within a predetermined range, and the generated phase angle is added to a phase angle originally provided. When a range for generating the phase angle is not limited, each phase component of the originally provided phase angle is replaced with the phase angle generated by the random number. In case that the speech signal is much degraded due to such as encoding, the range for generating the phase angle is not limited.

The inverse Fourier transformer 11 returns the spectrum to a signal region by operating the inverse Fourier transformation on the spectrum after disturbance supplied from the phase disturber 10. The inverse Fourier transformer 11 also windows the signal to smoothly concatenate with the previous and the subsequent frames, and the obtained signal is output to the weighted value adder 18 as the transformed decoded speech 34.

The inverse filter 13 of the signal evaluator 12 performs an inverse filtering on the decoded speech 5 supplied from the speech decoding unit 4 using the estimated noise spectral parameter stored in the estimated noise spectrum updater 17, which will be described later. The inversely filtered decoded speech is output to the power calculator 14. By performing the inverse filtering, a amplitude of the component of the period where the amplitude of the background noise is large, namely, there is high probability that the speech competes with the background noise, can be suppressed. The signal power ratio between the speech period and the background noise period becomes larger than a case without the inverse filtering.

The estimated noise spectral parameter is selected from a view point of an affinity with the speech encoding process or the speech decoding process, and of sharing the software. In most present cases, a line spectral pair (LSP) is used. Other than LSP, similar effect can be obtained by using a spectral enveloped parameter such as a linear predictive coefficient (LPC) and a cepstrum, or a amplitude spectrum itself. As for updating process performed by the estimated noise spectrum updater 17, which will be described later, a linear interpolation, an averaging process and so on are used for a simple configuration. Among the spectral enveloped parameters, the LSP and the cepstrum are recommended to use, since stable filtering can be guaranteed even when the linear interpolation or the averaging process is performed. The cepstrum is superior in an expressing ability for the noise component of the spectrum. On the other hand, the LSP is superior in easiness of configuration of the inverse filter. On using the amplitude spectrum, the LPC having a characteristic of the amplitude spectrum is calculated and the calculated result is used for the inverse filtering. In another way, the similar effect to the inverse filtering can be obtained by Fourier transforming the decoded speech 5, and transforming the amplitude of the Fourier transformed result (this equals to the output of the Fourier transformer 8).

The power calculator 14 obtains power of the decoded speech, which has been inversely filtered and supplied from the inverse filter 13, and the obtained result of power value is output to the background noise likeness calculator 15.

The background noise likeness calculator 15 calculates the background noise likeness of the present decoded speech 5 using the power input from the power calculator 14 and the estimated noise power stored in the estimated noise power updater 16, which will be explained later. The background noise likeness calculator 15 outputs the calculated result to the weighted value adder 18 as an addition control value 35. The calculated background noise likeness is also output to the estimated noise power updater 16 and the estimated noise spectrum updater 17, and the power value supplied from the power calculator 14 is output to the estimated noise power updater 16. The background noise likeness can be obtained, most simply, by calculating the following expression.

$$v = \log(p_N) - \log(p) \quad \text{expression 2}$$

where p represents the power input from the power calculator 14, $p_N$ represents the estimated noise power stored in the estimated noise updater 16, and v represents the calculated background noise likeness.

In this case, the larger the value of v becomes (if v is a negative number, the smaller the absolute value of v becomes), the more the result resembles the actual background noise. The background noise likeness v can be calculated by an operation of $p_N/p$, and in other ways.

The estimated noise power updater 16 updates the estimated noise power stored therein using the background noise likeness and the power supplied from the background noise likeness calculator 15. For example, when the background noise likeness is high (the value of v is large), the estimated noise power is updated by reflecting the input power using the following expression.

$$\log(p_N') = (1-\beta)\log(p_N) + \beta \log(p) \quad \text{expression 3}$$

where $\beta$ represents an updating speed constant having the value of 0 through 1, and the value relatively close to 0 is preferable to take. The estimated noise power is updated using the value $p_N'$ of the left side of the above expression by calculating the value of the right side of the expression.

As for updating process of the estimated noise power, in order to improve the precision of estimation, various applications or improvements can be done such as updating by referring to interframe variability, by storing a plurality of past input powers and estimating the noise power with statistical analysis, or, by taking the minimum value of p as the estimated noise power without any change.

The estimated noise spectrum updater 17 analyzes the input decoded speech 5 and calculates the spectral parameter of the present frame. As has been described in the explanation of the inverse filter 13, the LSP is used for the spectral parameter in most cases. The estimated noise spectrum updater 17 updates the estimated noise spectrum stored therein using the background noise likeness supplied from the background noise likeness calculator 15 and the calculated spectral parameter. For example, when the input background noise likeness is high (the value of v is large), the estimated noise spectrum is updated using the calculated spectral parameter given by the following expression.

$$x_N'=(1-\gamma)x_N+\gamma x \quad \text{expression 4}$$

where x represents the spectral parameter of the present frame, $x_N$ represents the estimated noise spectrum (parameter). γ represents an updating speed constant taking a value of 0 through 1, preferably taking a value close to 0. The estimated noise spectrum is updated by a new estimated noise spectrum (parameter) from $x_N'$ of the left side as a calculated result of the right side of the expression.

As for updating process of the estimated noise spectrum, various applications and improvements can be done as well as the above estimated noise power.

As the final process, the weighted value adder 18 weights and adds the decoded speech 5 supplied from the speech decoding unit 4 and the transformed decoded speech 34 supplied from the signal transformer 7 based on the addition control value 35 received from the signal evaluator 12, and the obtained result is output as the output speech 6. In connection with controlling operation of weighted addition, the more the addition control value 35 increases (background noise likeness is high), the smaller the weight is made for the decoded speech 5 and the larger the weight is made for the transformed decoded speech 34. On the contrary, the more the addition control value 35 decreases (background noise likeness is low), the larger the weight is made for the decoded speech 5 and the smaller the weight is made for the transformed decoded speech 34.

In order to suppress degradation of the quality caused by the sudden change of the weight between the frames, smoothing is desired to be performed so that the addition control value 35 or the weighting coefficient gradually change within each sample.

Figure 2:
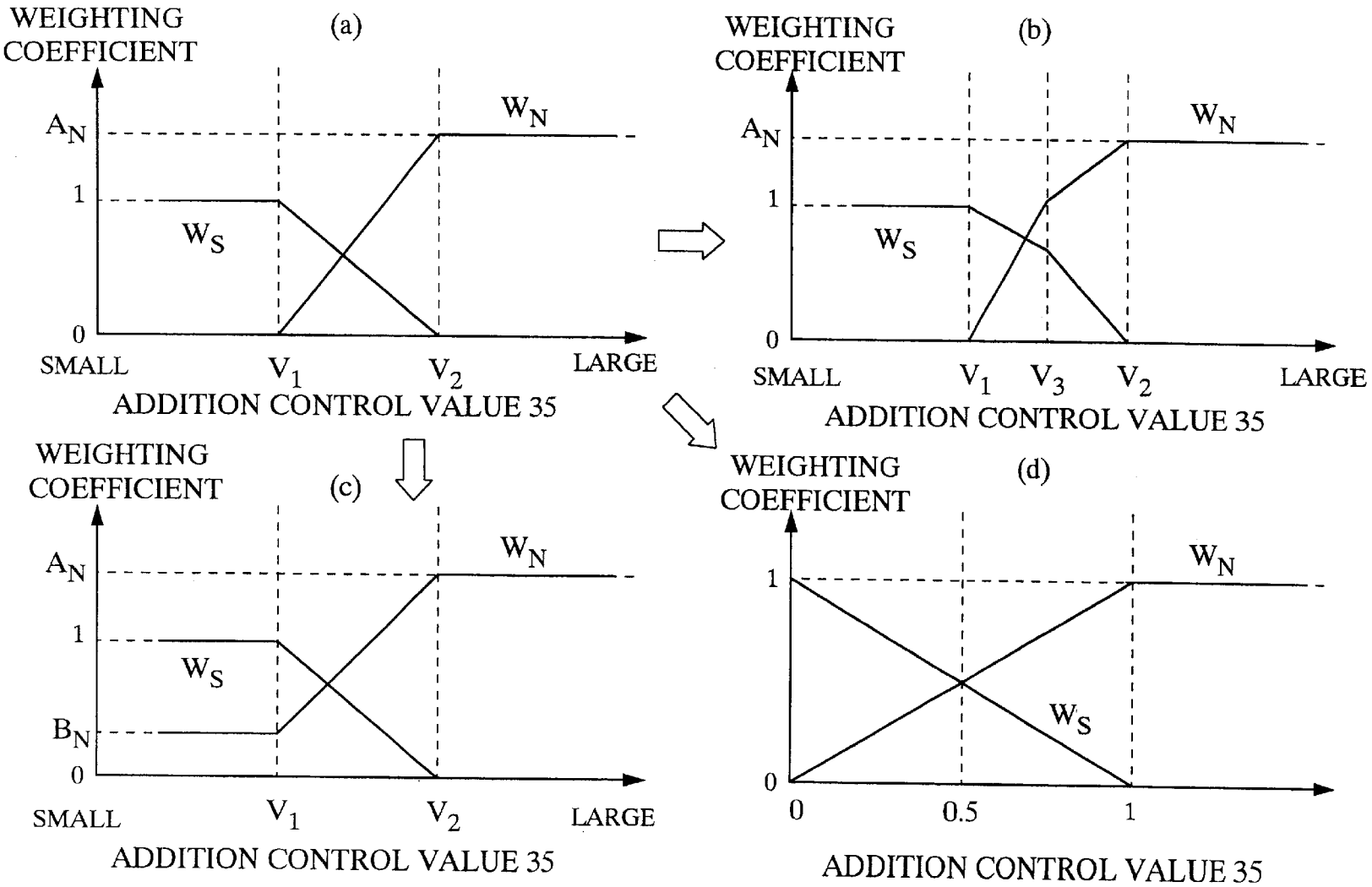
FIG. 2 shows an example of weighted addition based on an addition control value calculated by a weighted value adder 18 according to the first embodiment of the invention.

FIG. 2 shows examples of controlling operation using the addition control value by the weighted value adder 18.

FIG. 2(*a*) shows the case in which the addition control value 35 is linearly controlled using two threshold values $v_1$ and $v_2$. When the addition control value 35 is less than $v_1$, the weighting coefficient $w_S$ is made 1 for the decoded speech 5, and the weighting coefficient $w_N$ is made 0 for the transformed decoded speech 34. When the addition control value 35 is equal to or more than $v_2$, the weighting coefficient $w_S$ is made 0 for the decoded speech 5, and the weighting coefficient $w_N$ is made $A_N$ for the transformed decoded speech 34. When the addition control value 35 is equal to or more than $v_1$ and also less than $v_2$, the weighting coefficient $w_S$ is linearly calculated in the range of 1 through 0 for the decoded speech 5, and the weighting coefficient $w_N$ is linearly calculated in the range of 0 through $A_N$ for the transformed decoded speech 34.

By controlling as described above, when it is certainly detected as the background noise period (equal to or more than $v_2$), only transformed decoded signal 34 is output, and when it is certainly detected as the speech period (less than $v_1$), the decoded speech 5 itself is output. When it is impossible to determine whether to be the speech period or the background noise period (equal to or more than $v_1$ and less than $v_2$), the decoded speech 5 and the transformed decoded speech 34 are composed at the ratio depending to the possibility to be the speech period or to be the background noise period and the composed result is output.

At this stage, when it is certainly detected as the background noise period (equal to or more than $v_2$), equal to or less than 1 is given as the weighting coefficient $A_N$ for multiplying to the transformed decoded signal 34, which enables to suppress the amplitude of the background noise period. On the contrary, when equal to or more than 1 is given as the weighting coefficient $A_N$, the amplitude of the background noise period can be emphasized. In the background noise period, the reduction of the amplitude often occurs due to the speech encoding and decoding process. In such cases, the amplitude of the background noise period is emphasized to improve the reproductivity of the background noise. To implement whether the suppression or the emphasis of the amplitude will depend upon the application, request of the user and so on.

FIG. 2(*b*) shows a case in which a new threshold value $v_3$ is added and the weighting coefficient is linearly calculated between $v_1$ and $v_3$, and $V_3$ and $v_2$. When it is impossible to determine whether to be the speech period or the background noise period (equal to or more than $v_1$ and less than $v_2$), composing ratio can be set more precisely by controlling the value of the weighting coefficient at the location of the threshold value $v_3$. Generally, two signals having low correlation between their phases are added, the power of generated signal becomes less than the sum of powers of two original signals. The sum of two weighting coefficients is made more than 1 through $w_N$ within the range of equal to or more than $v_1$ and less than $v_2$, which suspends the reduction of the power of the generated signal. The same effect can be obtained by setting a value, which is a root of the weighting coefficient given by FIG. 2(*a*) multiplied by a constant, as a new weighting coefficient.

FIG. 2(*c*) shows a case in which $B_N$ being more than 0 is given as the weighting coefficient $w_N$ for weighting the transformed decoded speech 34 within the range of less than $v_1$ of FIG. 2(*a*), and the weighting coefficient $w_N$ within the range of equal to or more than $v_1$ and less than $v_2$ is modified correspondingly. This is effectively applied to the cases in which the quantization noise or degraded sound is high in the speech period, for instance, the background noise level is high, the compressibility of encoding is extremely high, and so on. In this way, even in the period certainly detected as the speech period, it is possible to make the degraded sound unperceptible by adding the transformed decoded speech.

FIG. 2(*d*) shows an example of controlling for a case in which the background noise likeness (addition control value 35) is given by the result ($p_N/p$) of a division of the estimated noise power by the present power and output by the background noise likeness calculator 15. In this case, the addition control value 35 shows a ratio of the background noise included in the decoded speech 5, and the weighting coefficient is calculated for composition at the ratio proportional to the value. Concretely, when the addition control value 35 is equal to or more than 1, $w_N$ is 1 and $w_S$ is 0, and when the addition control value 35 is less than 1, $w_N$ is set equal to the addition control value 35 and $w_S$ becomes $(1-w_N)$.

Figure 3:
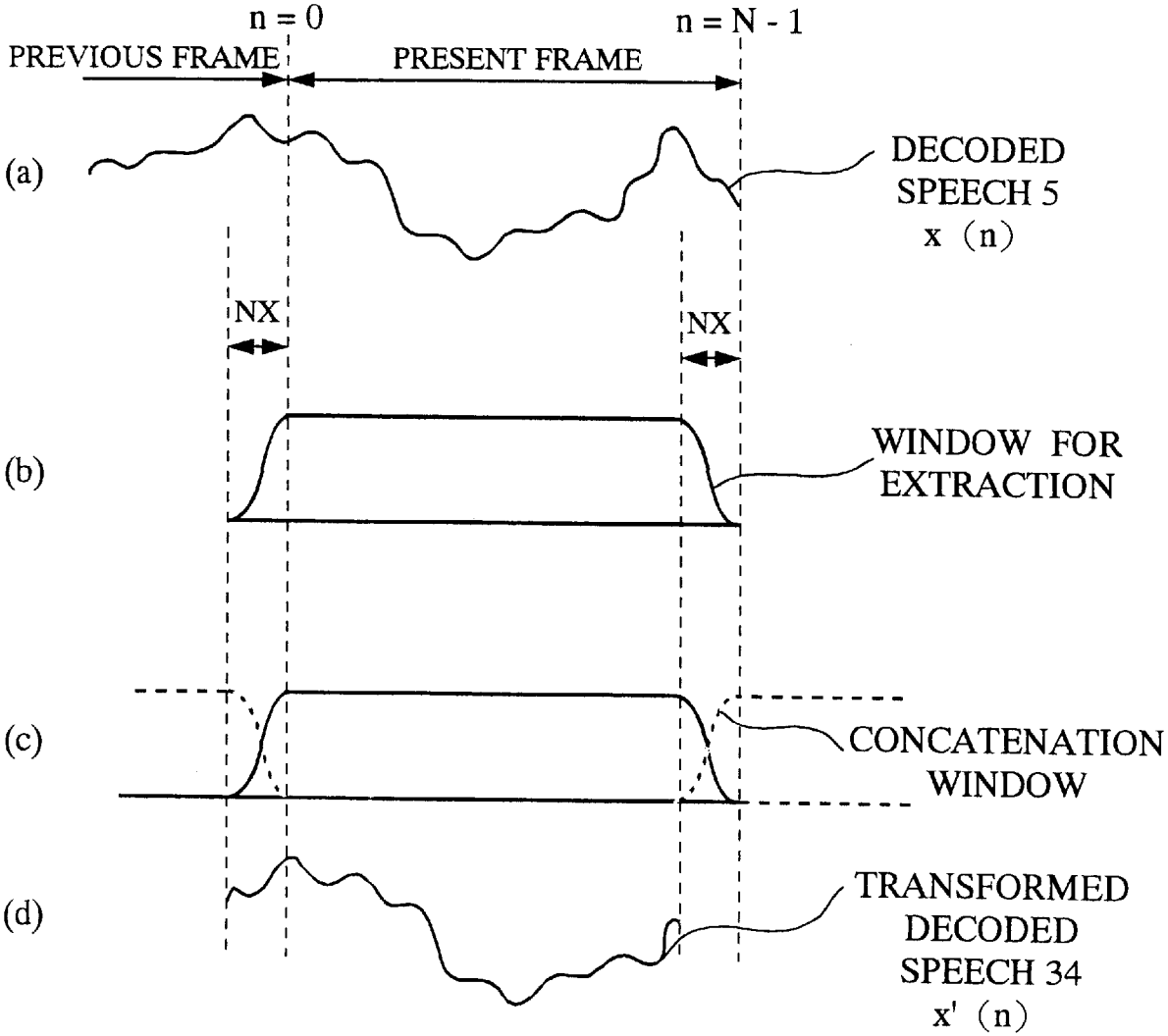
FIG. 3 shows an example of shapes of a window for extraction in a Fourier transformer 8 and a concatenation window in an inverse Fourier transformer 11, and explains a timing relationship with a decoded speech 5.

FIG. 3 shows examples of the shape of window for extraction in the Fourier transformer 8 and the window for concatenation in the inverse Fourier transformer 11 FIG. 3 also explains time relation to the decoded speech 5.

The decoded speech 5 is output from the speech decoding unit 4 each predetermined length of time (1 frame length). Here, 1 frame length is assumed to be N samples. FIG. 3(*a*) shows an example of the decoded speech 5, and the decoded speech 5 of the present frame corresponds to a part from x(0) through x(N−1). The Fourier transformer 8 segments a signal having length of (N+NX) by multiplying a transformed trapezoidal window shown as FIG. 3(*b*) to the decoded speech 5 shown as FIG. 3(*a*). NX shows each length of periods having the value of less than 1, which are leading and trailing edges of the transformed trapezoidal window. The length of each edge is equal to the length of Hunning window having the length of (2NX) divided into the first and second halves. The inverse Fourier transformer 11 multiplies the transformed trapezoidal window shown as FIG. 3(*c*) to a signal obtained by the inverse Fourier transformation, and generates continuous transformed decoded speech 34 (shown as FIG. 3(*d*)) by adding the signal with keeping the time relation among the signals obtained in the previous and subsequent frames (shown by broken lines in FIG. 3(*c*)).

The transformed decoded speech 34 for the period for concatenation with the signal of the next frame (length NX) has not been determined yet at the present frame. Namely, a new transformed decoded speech 34 to be obtained is a signal from x'(−NX) through x'(N−NX−1). Accordingly, the output speech 6 is obtained by the following expression corresponding to the decoded speech 5 of the present frame.

$$y(n)=x(n)+x'(n) \qquad \text{expression 5}$$

(n=−NX, . . . , N−NX−1)

In the above expression, y(n) shows the output speech 6. In this case, processing delay is required at least NX for the signal processing unit 2.

When the above processing delay NX cannot be approved by the application, the output speech 6 can be generated in another way by the following expression with approving the time lag between the decoded speech 5 and the transformed decoded speech 34.

$$y(n)=x(n)+x'(n-NX) \qquad \text{expression 6}$$

(n=0, . . . , N−1)

In the above case, there is a time lag between the decoded speech 5 and the transformed decoded speech 34. Because of this, the degradation of the output speech may occur in cases where the disturbance has not been sufficiently performed in the phase disturber 10 (namely, the phase characteristic of the decoded speech remains at some degree) and where the spectrum or the power suddenly changes within the frame. In particular, the degradation may tend to occur when the weighting coefficient of the weighted value adder 18 changes a lot and when two weighting coefficients compete with each other. However, it can be said the above degradation is comparatively small, and the effect of applying the signal processing unit is entirely large. Therefore, the above method can be applied to the processing object which cannot approve the processing delay NX.

In case of FIG. 3, the transformed trapezoidal windows are multiplied before the Fourier transformation and after the inverse Fourier transformation, which may reduce the amplitude of the concatenated parts. This reduction of amplitude tends to occur when the disturbance has not been sufficiently performed in the phase disturber 10. To avoid the reduction of amplitude, the window before the Fourier transformation is changed into a rectangular window. Generally, the phase is extremely transformed by the phase disturber 10 and as a result, the shape of the first transformed trapezoidal window does not appear in the signal on which the inverse Fourier transformation has been operated. Accordingly, secondly windowing is required for smooth concatenation with the transformed decoded speeches 34 of the previous frame and the subsequent frame.

In the above explanation, operations of the signal transformer 7, the signal evaluator 12 and the weighted value adder 18 are performed for each frame. The application of the embodiment is not limited to the operation for each frame. For example, one frame is divided into a plurality of sub-frames. The signal evaluator 12 can operate processing for each sub-frame and the addition control value 35 is calculated for each sub-frame, and the weighted control can be performed for each sub-frame in the weighted value adder 18. Fourier transformation is operated as signal transformation, so that when the frame length is very short, the result of analysis of the spectral characteristics becomes unstable, which makes difficult to stabilize the transformed decoded speech 34. On the other hand, a comparatively stable background noise likeness can be calculated for shorter frame length. Accordingly, the background noise likeness is calculated for each sub-frame to control precisely the weighted addition and the quality of the reproduced speech is improved in the leading edge part of the speech and so on.

The operation of the signal evaluator 12 can be also performed for each sub-frame, all of the addition control values within the frame are composed to calculate small number of the addition control values 35. To avoid to mistake the speech period for the background noise likeness, the smallest value of all addition control values (the minimum value of the background noise likeness) is selected and output as the addition control value 35 representing the frame.

Further, the frame length of the decoded speech 5 and the frame length for processing by the signal transformer 7 are not always required to be identical. For example, when the frame length of the decoded speech 5 is too short to be processed by the spectrum analysis within the signal transformer 7, the decoded speeches 5 of a plurality of frames is accumulated, and then the signal transformation is performed on the accumulated decoded speech at once. In this case, however, a processing delay occurs because of accumulation of the decoded speeches 5 of the plurality of frames. In another way, the frame length for processing by the signal transformer 7 or the signal processing unit 2 can be set independently of the frame length of the decoded speech 5. In this case, the operation of buffering the signal becomes complex. However, the most optimal frame length for processing can be selected independently of various frame length of the decoded speech 5, which enables to draw the best quality of the signal processing unit 2.

In the above explanation, the background noise likeness is calculated using the inverse filter 13, the power calculator 14, the background noise likeness calculator 15, the estimated background noise likeness level updater 16, and the estimated noise spectrum updater 17. The application of the embodiment is not limited to this configuration for evaluating the background noise likeness.

According to the first embodiment, predetermined signal processing is performed on the input signal (decoded speech) to generate a processed signal (transformed decoded speech) in which the degraded component included in the input signal has been changed to be subjectively unperceptible, and the weight is controlled by the predetermined evaluation value (background noise likeness) for adding to the input signal and the processed signal. Therefore, the ratio of the processed signal is increased mainly in the period where much degraded component is included, which improves the subjective quality.

The signal processing is performed within the spectral region, so that a degraded component can be suppressed precisely, which also enables to improve the subjective quality.

The amplitude spectral component is smoothed and the phase spectral component is disturbed, so that unstable variation of the amplitude spectral component caused by the quantization noise, etc. can be sufficiently suppressed. Further, the relation among phase components can be disturbed on the quantization noise, which often appears to be characteristically degraded due to the peculiar mutuality among the phase components. The subjective quality can be improved.

Conventionally, binary value discrimination is performed between the speech period and the background noise period. In this embodiment, instead of the discrimination, continuous amount of background noise likeness is calculated. Based on the calculated background noise likeness, the coefficient for weighted addition for the decoded speech and the transformed decoded speech can be continuously controlled, therefore, the degradation of the quality due to the misdetection of the periods can be avoided.

When the quantization noise or the degraded sound is large in the speech period, even when it is certainly detected as the speech period, the degraded sound can be made unperceptible by adding the transformed decoded speech.

The output speech is generated by processing the decoded speech which includes much information of background noise. Accordingly, the quality of the reproduced sound can be improved to be stable and rather independent of the kind of background noise or the shape of spectrum, and further, the degraded component cause by encoding the sound source can be also improved.

The decoding process is performed using the decoded speech up to the present, so that much delay is not required and depending on the kind of method for adding the decoded speech and the transformed decoded speech, the delay time can be eliminated other than the time required for process. The level of the decoded speech is decreased when the level of the transformed decoded speech is increased, so that there is no need to overlay a large pseudo-noise, which is conventionally required, to make the quantization noise unperceptible. On the contrary, the background noise level can be controlled to become smaller or larger depending on the application. Further, the decoding process is performed within the closed circuit such as the speech decoder or the signal processing unit, therefore, of course, there is no need to add new information for transmission, which is conventionally required to be added.

Further, in this first embodiment, the speech decoder and the signal processing unit are definitely separated, and a little information is transmitted between the speech decoder and the signal processing unit. Accordingly, this embodiment can be introduced into various kinds of speech decoder including existing ones.

Embodiment 2

Figure 4:
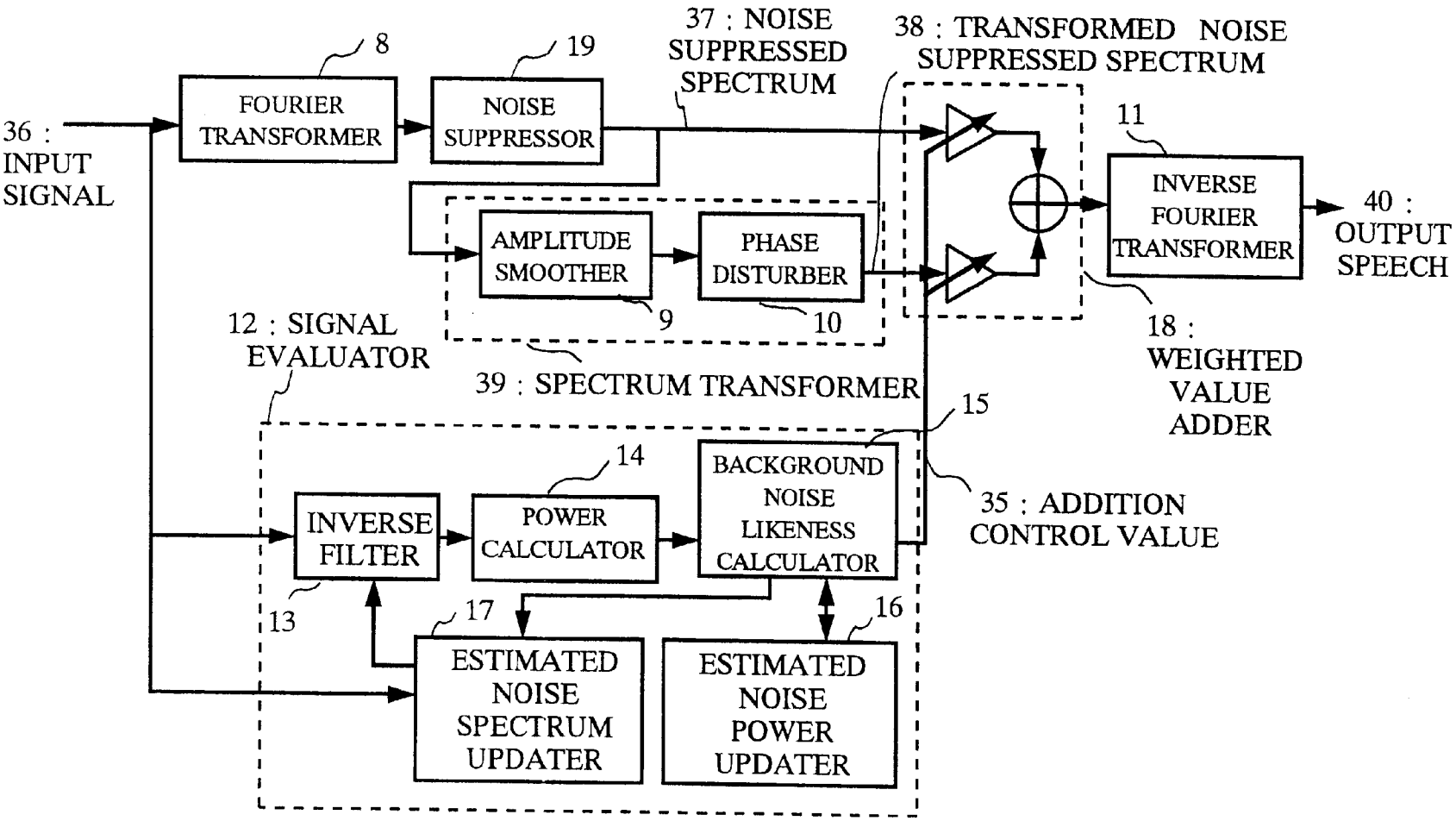
FIG. 4 shows a partial configuration of a speech decoding apparatus applying a sound signal processing method and a noise suppressing method according to a second embodiment of the invention.

FIG. 4 shows a partial configuration of a sound signal processing apparatus implementing the sound signal processing method and the noise suppressing method combined according to the second embodiment. In the figure, a reference numeral 36 shows an input signal, a reference numeral 8 shows a Fourier transformer, 19 shows a noise suppressor, 39 shows a spectrum transformer, 12 shows a signal evaluator, 18 shows a weighted value adder, 11 shows an inverse Fourier transformer, and 40 shows an output signal. The spectrum transformer 39 is configured by a amplitude smoother 9 and a phase disturber 10.

In the following, an operation will be explained by referring to the figure.

First, the input signal 36 is received at the Fourier transformer 8 and the signal evaluator12.

The Fourier transformer 8 multiplies a predetermined window to a signal composed of the input signal 36 of the present frame and if necessary, a newest part of the input signal 36 of the previous frame. The Fourier transformer 8 operates Fourier transformation on the windowed signal to calculate the spectral component for each frequency to output to the noise suppressor 19. The Fourier transformation and windowing is performed in the same way as in the first embodiment.

The noise suppressor 19 subtracts the estimated noise spectrum stored inside of the noise suppressor 19 from the spectral component for each frequency supplied from the Fourier transformer 8. The noise suppressor 19 outputs the subtracted result to the weighted value adder 18 and the amplitude smoother 9 of the spectrum transformer 39 as a noise suppressed spectrum 37. This operation corresponds to a main part of the so-called spectrum subtraction. The noise suppressor 19 discriminates whether it is the background noise period or not. When it is detected to be the background noise period, the noise suppressor 19 updates the estimated noise spectrum stored therein using the spectral component for each frequency input from the Fourier transformer 8. It is possible to facilitate the discrimination whether it is the background noise period or not by taking the output result of the signal evaluator 12, an operation will be described later.

The amplitude smoother 9 of the spectrum transformer 39 smoothes the amplitude component of the noise suppressed spectrum 37 input from the noise suppressor 19, and outputs the smoothed noise suppressed spectrum to the phase disturber 10. As for smoothing process described herein, the degraded sound generated by the noise suppressor can be suppressed by smoothing in either of the frequency axis direction or the time axis direction. Concretely, the same smoothing method as one in the first embodiment can be applied.

The phase disturber 10 inside of the spectrum transformer 39 disturbs the phase component of the smoothed noise suppressed spectrum input from the amplitude smoother 9, and the disturbed spectrum is output to the weighted value adder 18 as the transformed noise suppressed spectrum 38. The same method as the first embodiment can be also applied to disturb each phase.

The signal evaluator 12 analyzes the input signal 36 to calculate the background noise likeness, and outputs the calculated result to the weighted value adder 18 as the addition control value 35. The same configuration and processing as the signal evaluator 12 in the first embodiment can be applied.

Based on the addition control value 35 input from the signal evaluator 12, the weighted value adder 18 weights and adds the noise suppressed spectrum 3.7 input from the noise suppressor 19 and the transformed noise suppressed spectrum 38 input from the spectral transformer 39, and the obtained spectrum is output to the inverse Fourier transformer 11. On controlling the weighted addition, as well as in the first embodiment, the weight for the noise suppressed spectrum 37 should be controlled to be smaller and the weight for the transformed noise suppressed spectrum 37 should be controlled to be larger as the addition control value 35 becomes larger (the background noise likeness is higher). On the contrary, as the addition control value 35 becomes smaller (the background noise likeness is lower), the weight for the noise suppressed spectrum 37 should be controlled to be larger and the weight for the transformed noise suppressed spectrum 38 should be controlled to be smaller.

Then, as the final process, the inverse Fourier transformer 11 operates inverse Fourier transformation on the spectrum input from the weighted value adder 18, which returns the spectrum to the signal region. The inverse Fourier transformer windows the present frame to smoothly concatenate with the previous and the subsequent frames, and the obtained signal is output as the output signal 40. As for windowing process and concatenating process can be operated in the same way as the first embodiment.

According to the second embodiment, a predetermined processing is performed on the degraded spectrum caused by noise suppression etc. to generate processed spectrum (transformed noise suppressed spectrum), of which the degraded component is made subjectively unperceptible. The weight for addition is controlled for the unprocessed spectrum and for the processed spectrum using a predetermined evaluation value (background noise likeness). Therefore, the embodiment improves the subjective quality by raising a ratio of the, processed spectrum mainly in the period where the input signal includes much degraded component, which decreases the subjective quality (the, background noise period).

Further, in the present embodiment, the weighted addition is operated in the spectral region, which facilitates the process because the Fourier transformation and the inverse Fourier transformation, which is operated in the first embodiment, is not required. The noise suppressor 19 of the second embodiment originally requires the Fourier transformer 8 and the inverse Fourier transformer 11.

The amplitude spectral component is smoothed and the phase spectral component is disturbed as a processing, which effectively suppresses unstable variation of the amplitude spectral component caused by such as the quantization noise. Further, the relationship between the phase components of the quantization noise or the degraded component, which tends to be a particular: correlation to cause a characteristic degradation, can be disturbed to improve the subjective quality.

Instead of the binary value discrimination, in which the period is discriminated whether the background noise period or not, the continuous amount of the background noise likeness is calculated. Based on this, the weighted addition coefficient is continuously controlled, which prevents the degradation of the quality caused by misdetection of the period.

When the degraded sound is large in the period other than the background noise period, the weighted addition is operated as shown in FIG. 2(*c*). Accordingly, the degraded sound is made unperceptible by adding the transformed noise suppressed spectrum to the noise suppressed spectrum in the period which is certainly detected as one other than the background noise period.

Further, the transformed noise suppressed spectrum is generated by performing a simple processing on the noise suppressed spectrum, so that the stable improvement of the quality without depending on the kind of noise or the shape of spectrum so much can be obtained Further, the process is performed using the noise suppressed spectrum up to the present, so that much delay time is not required in addition to the delay time required by the noise suppressor 19. On increasing the addition level of the transformed noise suppressed spectrum, the additional level of the original noise suppressed spectrum is decreased. Therefore, it is not required to overlay a relatively large noise in order to make the quantization noise unperceptible, and the background noise level can be decreased. Further, even when the process of the embodiment is applied to the preprocessing of the speech encoding, the operation is performed within the closed circuit of the encoder, therefore, of course, there is no need to add new information for transmission, which is conventionally required to add.

Embodiment 3

Figure 5:
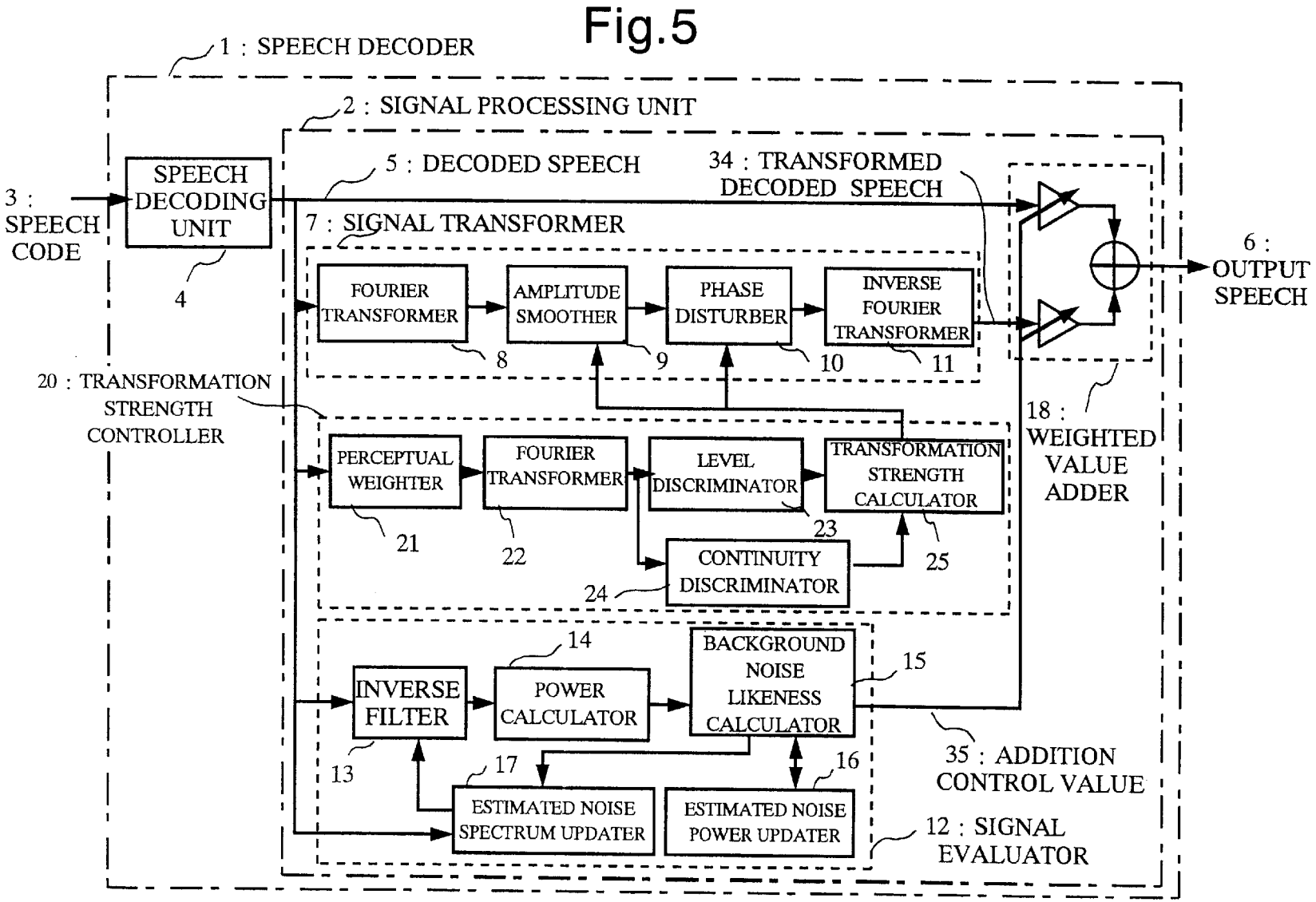
FIG. 5 shows a general configuration of a speech decoding apparatus applying a speech decoding method according to a third embodiment of the invention.

FIG. 5 shows a general configuration of the speech decoder applying a sound signal processing method according to the present embodiment and in FIG. 5, the same reference numerals are assigned to corresponding elements to ones shown in FIG. 1. In the figure, a reference numeral 20 shows a transformation strength controller outputting information to control the transformation strength of the signal transformer 7. The transformation strength controller 20 is configured by a perceptual weighter 21, a Fourier transformer 22, a level discriminator 23, a continuity discriminator 24, and a transformation strength calculator 25.

In the following, an operation will be described referring to the figure.

The decoded speech 5 output from the speech decoding unit 4 is input to each of the signal transformer 7, the transformation strength controller 20, the signal evaluator 12, and the weighted value adder 18 of the signal processing unit 2.

The perceptual weighter 21 of the transformation strength controller 20 perceptually weights the decoded speech 5 input from the speech decoding unit 4, and the perceptually weighted speech is output to the Fourier transformer 22. Here, the perceptually weighting process is performed similarly to the one performed in the speech encoding process (corresponding process to the speech decoding process performed in the speech decoding unit 4).

In the perceptually weighting process which is often used for the encoding process such as CELP(code exited linear prediction), a speech to be encoded is analyzed, a linear prediction coefficient (LPC) is calculated, and LPC is multiplied by a constant to obtain two transformed LPCs. An ARMA filter is constructed having these two transformed LPCs as filtering coefficients, and the perceptually weighting is performed by filtering using the ARMA filter. To perceptually weight the decoded speech 5 similarly to the encoding process, two transformed LPCs are calculated based on the LPC obtained by decoding the input speech code 3, or the LPC obtained by re-analyzing the decoded speech 5. The perceptual weighting filter is constructed using these transformed LPCs.

In the encoding process such as CELP, the encoding is performed so as to minimize the distortion on the perceptually weighted speech. It can be said that the quantization noise is not overlaid much when the amplitude is large in the spectral component of the perceptually weighted speech. Accordingly, if it is possible to generate a speech which is similar to the perceptually weighted speech of the encoding process in the decoder 1, the generated speech becomes useful information for controlling the transformation strength in the signal transformer 7.

When a processing step such as spectral postfiltering is included in the speech decoding process by the speech decoding unit 4 (this step is included in most cases of CELP), the speech which is similar to the perceptually weighted speech of the encoding process can be obtained by perceptually weighting the speech generated by removing influence of processing such as spectral postfiltering from the decoded speech 5, or extracting the speech before processing from the speech decoding unit 4. However, when it is a main object to improve the quality of the reproduced sound of the background noise period, it makes little difference if the influence is not removed because the influence of processing such as spectral postfiltering in the period is small. The third embodiment is configured without removing the influence of processing such as spectral postfiltering.

The perceptual weighter 21 is not required when perceptually weighting is not performed in the encoding process, or even if performed, when the influence of the perceptually weighting is small and can be ignored. In such a case, neither the Fourier transformer 22 is required, because the output from the Fourier transformer 8 of the signal transformer 7 can be transmitted to the level discriminator 23 and the continuity discriminator 24, which will be described later.

Further, another method can be applied, which brings similar effect to the perceptually weighting, such as nonlinear amplitude transformation in the spectral region. Accordingly, when the difference can be ignored with the perceptually weighting method in the encoding process, the output from the Fourier transformer 8 of the signal transformer 7 is input to the perceptual weighter 21, the perceptual weighter 21 perceptually weights the input in the spectral region, the Fourier transformer 22 can be removed, and the perceptually weighted spectrum is output to the level discriminator 23 and the continuity discriminator 24, which will be described later.

The Fourier transformer 22 of the transformation strength controller 20 windows the signal composed of the perceptually weighted speech input from the perceptual weighter 21 and if necessary, the newest part of the perceptually weighted speech of the previous frame. The Fourier transformer 22 operates Fourier transformation on the windowed signal to calculate the spectral component for each frequency, and outputs the obtained spectral component to the level discriminator 23 and the continuity discriminator 24 as the perceptually weighted spectrum. The Fourier transformation and the windowing process is the same performed by the Fourier transformer 8 of the first embodiment.

Figure 6:
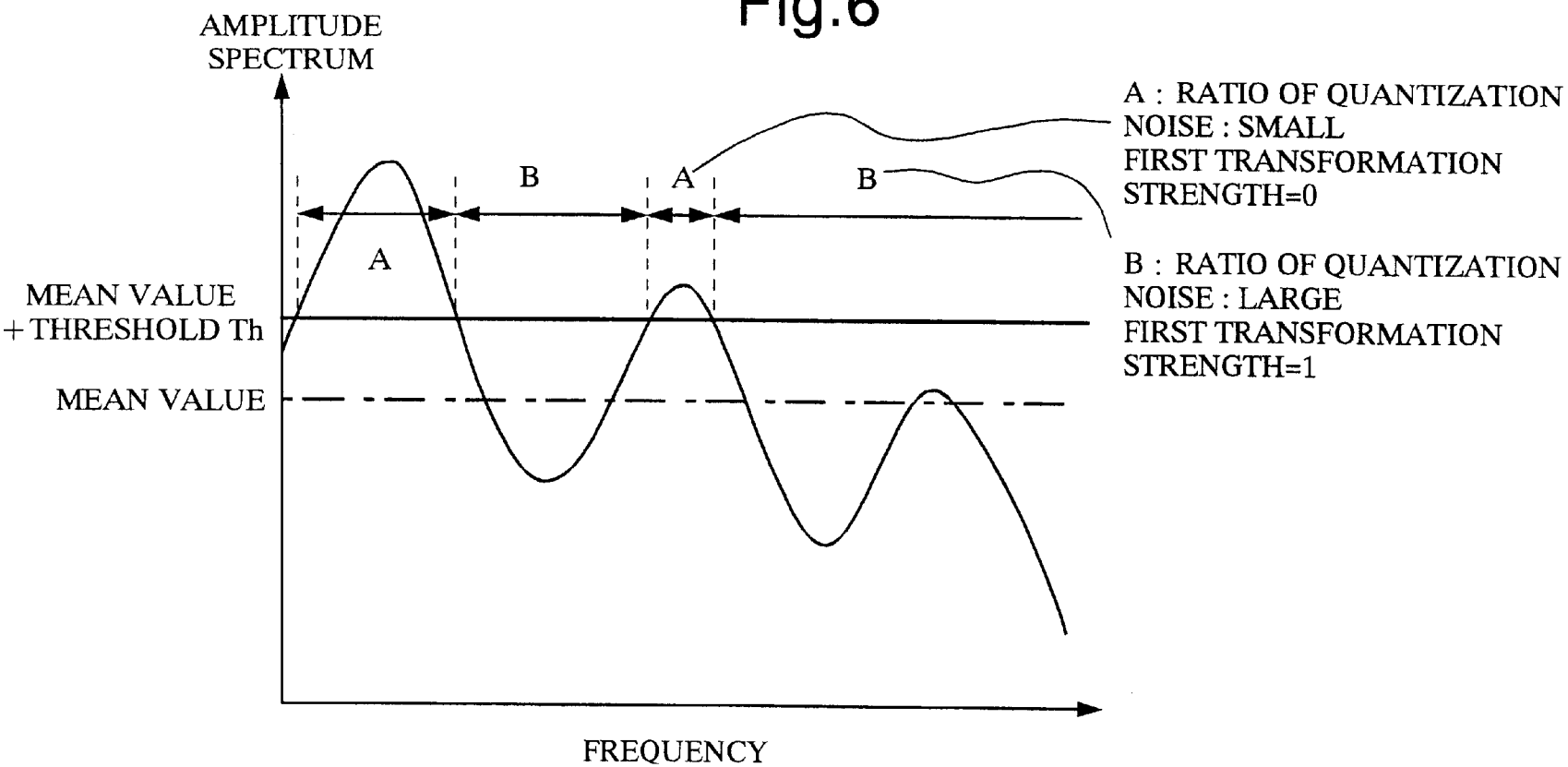
FIG. 6 show a relationship between a perceptually weighted spectrum and first transformation strength according to the third embodiment of the invention.

The level discriminator 23 calculates the first transformation strength for each frequency based on the value of each amplitude component of the perceptually weighted spectrum input from the Fourier transformer 22 and outputs the calculated result to the transformation strength calculator 25. The smaller the value of each amplitude component of the perceptually weighted spectrum, the larger a ratio of the quantization noise becomes, so that the first transformation strength should be strengthened. To simplify the procedure the most, the mean value of all amplitude components is obtained, and the predetermined threshold value Th is added. When the amplitude component is more than this added value, the first transformation strength is set to 0, and when the amplitude component is less than this added value, the first transformation strength is set to 1. FIG. 6 shows the relationship between the perceptually weighted spectrum and the first transformation strength in case the threshold value Th is used. The calculation method for the first transformation strength is not limited to the above.

The continuity discriminator 24 evaluates the time-based continuity of each amplitude component or each phase component of the perceptually weighted spectrum input from the Fourier transformer 22, calculates second transformation strength for each frequency based on the evaluated result, and outputs the second transformation strength to the transformation strength calculator 25. When the time-based continuity of the amplitude component or the continuity of the phase component of the perceptually weighted spectrum (after the rotation of the phase caused by transition of time between the frames has been compensated) is discriminated to be low, it cannot be considered that the encoding has been sufficiently performed, so that the second transformation of the frequency component should be strengthened. For calculating the second transformation strength, to simplify the procedure the most, the predetermined threshold value is used for discrimination to give either of 0 and 1.

The transformation strength calculator 25 calculates the final transformation strength for each frequency based on the first transformation strength supplied from the level discriminator 23 and the second transformation strength supplied from the continuity discriminator 24, and outputs the calculated result to the amplitude smoother 9 and the phase disturber 10 of the signal transformer 7. This final transformation strength can be represented by various values such as the minimum value, the mean weighted value, and the maximum value of the first transformation strength and the second transformation strength. This terminates the explanation of the operation of the transformation strength controller 20, which is newly added for the third embodiment.

The elements whose operation has been changed due to the addition of the transformation strength controller 20 will be explained in the following.

The amplitude smoother 9 smoothes the amplitude component of the spectrum for each frequency supplied from the Fourier transformer 8 based on the transformation strength supplied from the transformation strength controller 20, and outputs the smoothed spectrum to the phase disturber 10. At this time, the larger the transformation strength of the frequency component is, the more strongly smoothing is controlled to be performed. The simplest way to control the smoothing strength, smoothing should be done only when the input transformation strength is large. In other ways to strengthen smoothing, the smoothing coefficient a is made small in the numerical expression for smoothing explained in the first embodiment, or the spectrum on which the fixed smoothing has been performed and the spectrum before smoothing are weighted and added to generate the final spectrum, and the weight is made small for the spectrum before smoothing, and so on.

The phase disturber 10 disturbs the phase component of the smoothed spectrum input from the amplitude smoother 9 based on the transformation strength supplied from the transformation strength controller 20, and outputs the disturbed spectrum to the inverse Fourier transformer 11. At this time, the larger the transformation strength of the frequency component is, the more largely the phase is controlled to be disturbed. The simplest way to control the strength of disturbing, the component should be disturbed only when the input transformation strength is large. Various methods can be applied to controlling disturbing; scaling up or down the range of the phase angle generated by random numbers and so on.

As for other configurational elements, the operations are the same as ones in the first embodiment, and the explanation is omitted here.

In the above operation, both of the outputs from the level discriminator 23 and the continuity discriminator 24 are used. However, the embodiment can be configured to use only one of the outputs and to eliminate to supply the other output. Further, another configuration can be used to include only one of the amplitude smoother 9 and the phase disturber 10 to be controlled based on the transformation strength.

According to the third embodiment, the transformation strength for generating the processed signal (transformed decoded speech) is controlled for each frequency based on the amplitude of each frequency, or the continuity of the amplitude or the continuity of the phase of each frequency of the input signal (decoded speech) or the perceptually weighted input signal (decoded speech). Processing is performed mainly to the component where the quantization noise or the degraded component are to be dominant because the amplitude spectrum component is small, or to the component where the quantization noise or the degraded component are to be large because the continuity of the spectral component is low. The third embodiment does not process a good component including small amount of the quantization noise or the degraded component. Therefore, in addition to the effect of the first embodiment, the quantization noise or the degraded component can be subjectively suppressed while the characteristics of the input signal or the actual background noise can be remain relatively well, which improves the subjective quality.

Embodiment 4

Figure 7:
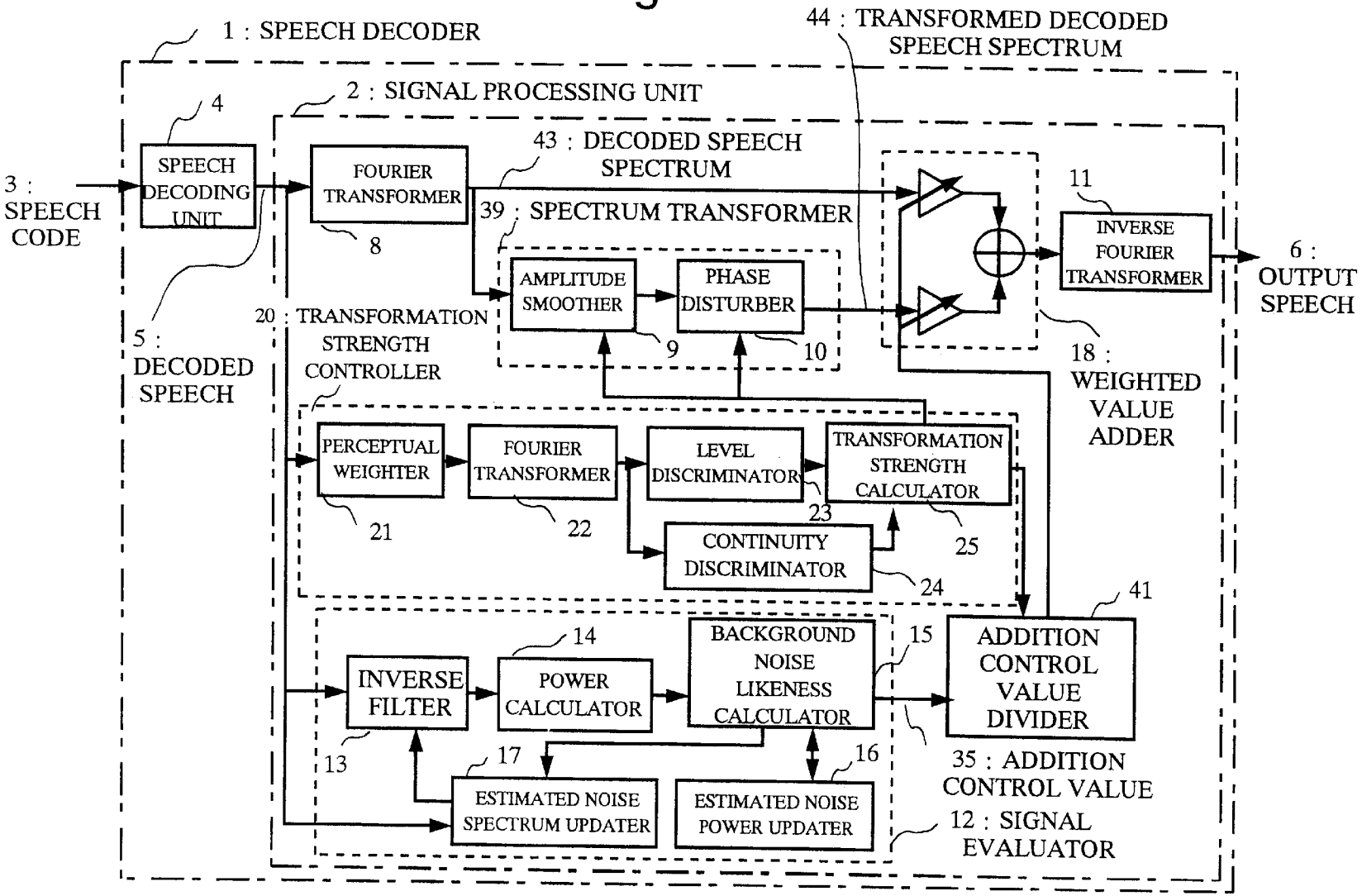
FIG. 7 shows a general configuration of a speech decoding apparatus applying a speech decoding method according to a fourth embodiment of the invention.

FIG. 7 shows a general configuration of the speech decoder applying a sound signal processing method according to the present embodiment, and in FIG. 7, the same reference numerals are assigned to corresponding elements to ones shown in FIG. 5. In the figure, a reference numeral 41 shows an addition control value divider. The Fourier transformer 8, a spectrum transformer 39, and the inverse Fourier transformer 11 are now used instead of the signal transformer 7 shown in FIG. 5.

In the following, an operation will be described referring to the figure.

The decoded speech 5 output from the speech decoding unit 4 is input to each of the Fourier transformer 8, the transformation strength controller 20, and the signal evaluator 12 of the signal processing unit 2.

In the same way as the second embodiment, the Fourier transformer 8 windows a signal composed of an input decoded speech 5 of the present frame and if necessary, a newest part of the decoded speech 5 of the previous frame. The Fourier transformation is operated on the windowed signal and the spectral component is calculated for each frequency. The obtained spectral component is output to the weighted value adder 18 and the amplitude smoother 9 of the spectral transformer 39 as the decoded speech spectrum 43.

The spectrum transformer 39 processes the input decoded speech spectrum 43 sequentially through the amplitude smoother 9 and the phase disturber 10 as well as.,the second embodiment. The spectrum transformer 39 outputs the obtained spectrum to the weighted value adder 18 as the transformed decoded speech spectrum 44.

In the transformation strength controller 20, the input decoded speech 5 is processed sequentially through the perceptual weighter 21, the Fourier transformer 22, the level discriminator 23, the continuity discriminator 24, the transformation strength calculator 25 as well as the third embodiment. The transformation strength controller 20 outputs the obtained transformation strength for each frequency to the addition control value divider 41.

In the above case, as well as the third embodiment, the perceptual weighter 21 and the Fourier transformer 22 become unnecessary when perceptually weighting has not been performed in the encoding process, or when the influence of the perceptually weighting is small and can be ignored. In such a case, the output from the Fourier transformer 8 is supplied to the level discriminator 23 and the continuity discriminator 24.

As for another way of configuration, the output of the Fourier transformer 8 is supplied to the perceptual weighter 21, the perceptual weighter 21 perceptually weights the input in the spectral region. The Fourier transformer 22 is removed, and the perceptually weighted spectrum is output to the level discriminator 23 and the continuity discriminator 24, which will be explained later. The process can be facilitated by the above configuration.

The signal evaluator 12, as well as in the first embodiment, obtains the background noise likeness from the input decoded speech 5 and outputs the obtained background noise likeness to the addition control value divider 41 as the addition control value 35.

The newly provided addition control value divider 41 generates an addition control value 42 for each frequency using the transformation strength for each frequency input from the transformation strength controller 20 and the addition control value 35 input from the signal evaluator 12 and outputs the generated addition control value 42 to the weighted value adder 18. When the transformation strength of the frequency is large, the addition control value 42 of the frequency is controlled so that the weight for the decoded speech spectrum 43 is made weak, and the weight for the transformed decoded speech spectrum 44 is made strong in the weighted value adder 18. On the contrary, when the transformation strength of the frequency is small, the addition control value 42 of the frequency is controlled so that the weight for the decoded speech spectrum 43 is made strong, and the weight for the transformed decoded speech spectrum 44 is made weak in, the weighted value adder 18. Namely, when the transformation strength of the frequency is large, the background noise likeness is high, so that the addition control value 42 for the frequency should be made large., In the opposite case, the addition control value 42 should be made small.

The weighted value adder 18 weights and adds the decoded speech spectrum 43 input from the Fourier transformer 8 and the transformed decoded speech spectrum 44 input from the spectrum transformer 39 based on the addition control value 42 for each frequency supplied from the addition control value divider 41, and the obtained spectrum is output to the inverse Fourier transformer 11. As for the controlling operation of the weighted addition, similarly to the case which has been explained referring to FIG. 2, when the addition control value 42 for the frequency component is large (the background ;noise likeness is high), the weight for the decoded speech spectrum 43 is, made small, and the weight for the transformed decoded speech spectrum 44 is made large. On the contrary, when the addition control value: 42 for the frequency component is small (the background noise likeness is low), the weight for the decoded speech spectrum 43 is made large, and the weight for the transformed decoded speech spectrum 44 is made small.

Then, for the final process, the inverse Fourier transformer 11, as well as the second embodiment, operates the inverse Fourier transformation on the spectrum input from the weighted value adder 18, which returns the spectrum to the signal region. The inverse Fourier transformer 11 concatenates the signal of the present frame with the previous and the subsequent frames with windowing for smooth concatenation, and the obtained signal is output as the output speech 6.

As for another configuration, the addition control value divider 41 is removed, and the output from the signal evaluator 12 is supplied to the weighted value adder 18, and the transformation strength output from the transformation strength controller 20 is supplied to both of the amplitude smoother 9 and the phase disturber 10. This configuration corresponds to the case in which the weighted addition is performed in the spectral region in the configuration of the third embodiment.

Further, as for another configuration, as well as the third embodiment, only one of the level discriminator 23 and the continuity discriminator 24 is used, and the other can be eliminated.

According to the fourth embodiment, the weighted addition of the spectrum of the input signal (decoded speech spectrum) and the processed spectrum (transformed decoded speech spectrum) can be independently controlled for each frequency component based on the amplitude for each frequency component, based on the continuity of the amplitude or the continuity of the phase for each frequency of the input signal (decoded speech) or the perceptually weighted input signal (decoded speech). The weight of the processed spectrum is strengthened mainly to the component in which the quantization noise or the degraded component are dominant because the amplitude spectrum component is small, or the component in which the quantization noise or the degraded component are large because the continuity of the spectral component is low. The fourth embodiment does not strengthen the weight of the processed spectrum for a good component including small amount of the quantization noise or the degraded component. Therefore, in addition to the effect of the first embodiment, the quantization noise or the degraded component can be subjectively suppressed while the characteristics of the input signal or the actual background noise can remain relatively well, which improves the subjective quality.

Compared with the third embodiment, two transformation processes of smoothing and disturbing for each frequency are changed into one transformation process for each frequency, which facilitates the procedure.

Embodiment 5

Figure 8:
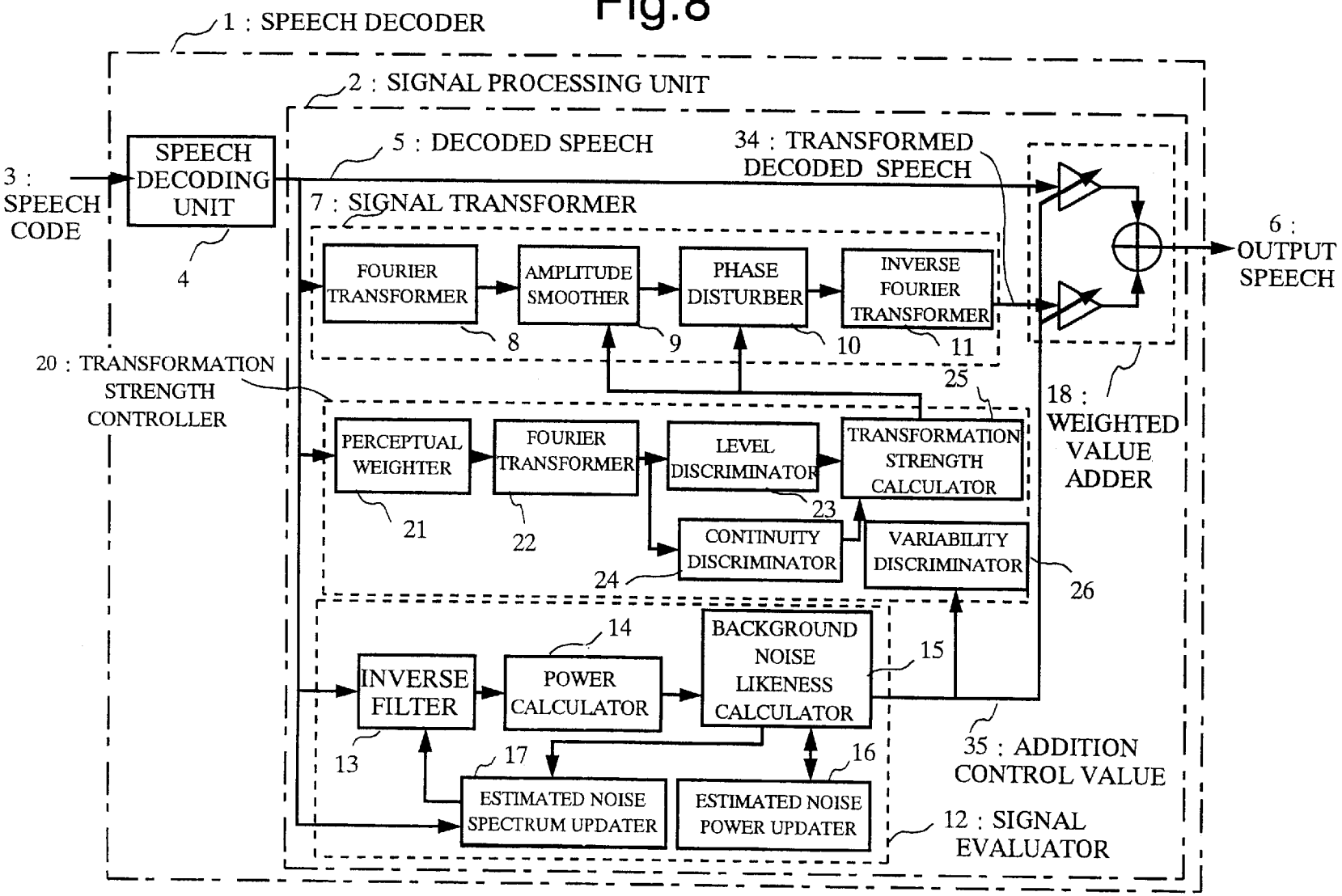
FIG. 8 shows a general configuration of a speech decoding apparatus applying a speech decoding method according to a fifth embodiment of the invention.

FIG. 8 shows a general configuration of the speech decoder applying a sound signal processing method according to the present embodiment, and in FIG. 8, the same reference numerals are assigned to corresponding elements to ones shown in FIG. 5. In the figure, a reference numeral 26 shows a variability discriminator discriminating the time-based variability of the background noise likeness (addition control value 35).

In the following, an operation will be described referring to the figure.

The decoded speech 5 output from the speech decoding unit 4 is input to each of the signal transformer 7, the transformation strength controller 20, the signal evaluator 12, and the weighted value adder 18 of the signal processing unit 2. The signal evaluator 12 evaluates the background noise likeness of the input decoded speech 5, and the evaluated result is output to the variability discriminator 26 and the weighted value adder 18 as the addition control value 35.

The variability discriminator 26 compares the addition control value 35 input from the signal evaluator 12 with the past addition control value 35 stored in the variability discriminator 26 to check the time-based variability of the value is high or low. Based on the compared result, the third transformation strength is calculated and output to the transformation strength calculator 25 of the transformation strength controller 20. The past addition control value 35 stored in the variability discriminator 26 is updated by using the input addition control value 35.

When the time-based variability of the parameter showing the characteristics of the frame (or sub-frame) such as the addition control value 35 is high, the spectrum of the decoded speech 5 changes largely in the time direction in most cases. In such cases, if the amplitude is smoothed too much or the phase is disturbed too much, it may generate unnatural echo. Therefore, in case the time-based variability of the addition control value 35 is high, the third transformation strength is set to reduce the extent of smoothing by the amplitude smoother 9 and of disturbing by the phase disturber 10. In this case, other parameter can be used for obtaining similar effect such as the power of the decoded speech or the spectral envelope parameter as long as it is a parameter showing the characteristics of the frame (or sub-frame).

As for the discriminating method of the variability, the simplest way is to compare the absolute value of difference to the addition control value 35 of the previous frame with the predetermined threshold value, and to discriminate that the variability is high when the absolute value is larger than the threshold value. Another way is to calculate the absolute value of each difference to the addition control values of the previous frame and the frame before the previous frame, and to discriminate the variability by detecting whether one of these absolute values is larger than the predetermined threshold value or not. In another way, when the signal evaluator 12 calculates the addition control value 35 for each sub-frame, the absolute value of each of differences among the addition control values 35 of all sub-frames of the present frame, or if necessary, all sub-frames of the previous frame is calculated. The variability is discriminated by detecting if any of the obtained absolute values is larger than the predetermined threshold value or not. More concretely, the third transformation strength is set to 0 when the absolute value is larger than the threshold value, and the third transformation strength is set to 1 when the absolute value is smaller than the threshold value.

In the transformation strength controller 20, the input decoded speech 5 is processed through the perceptual weighter 21, the Fourier transformer 22, the level discriminator 23, and the continuity discriminator 24 as well as the third embodiment.

Then, in the transformation strength calculator 25, the final transformation strength is calculated for each frequency based on the first transformation strength supplied from the level discriminator 23, the second transformation strength supplied from the variability discriminator 24, and the third transformation strength supplied from the continuity discriminator 26. The calculated final transformation strength is output to the amplitude smoother 9 and the phase disturber 10 of the signal transformer 7. In another way, the final transformation strength can be calculated by setting the third transformation strength for all frequencies as the predetermined value, and by obtaining the minimum value, the weighted mean value, and the maximum value and so on are obtained among the third transformation strength enhanced to all the frequencies, the first transformation strength, and the second transformation strength.

The operations of the signal transformer 7 and the weighted value adder 18 are the same as ones in the third embodiment, and an explanation is omitted here.

In the above method, the output results of both of the level discriminator 23 and the continuity discriminator 24 are used, however, it can be configured to use only one of them, or none of them. The object for controlling based on the transformation strength can be limited to only one of the amplitude smoother 9 and the phase disturber 10. In another way, it can be configured to control only one of the above based on the third transformation strength.

According to the fifth embodiment, in addition to the configuration of the third embodiment, the smoothing strength or the disturbing strength is controlled by the time variability (variability between frames or sub-frames) of the predetermined evaluation value (background noise likeness). Therefore, in addition to the effect of the third embodiment, the processing can be controlled not to process too much in the period where the characteristics of the input signal (decoded speech) varies. Further, in addition to the effect of the third embodiment, the present embodiment prevents generating laziness or echo (sense of echo).

Embodiment 6

Figure 9:
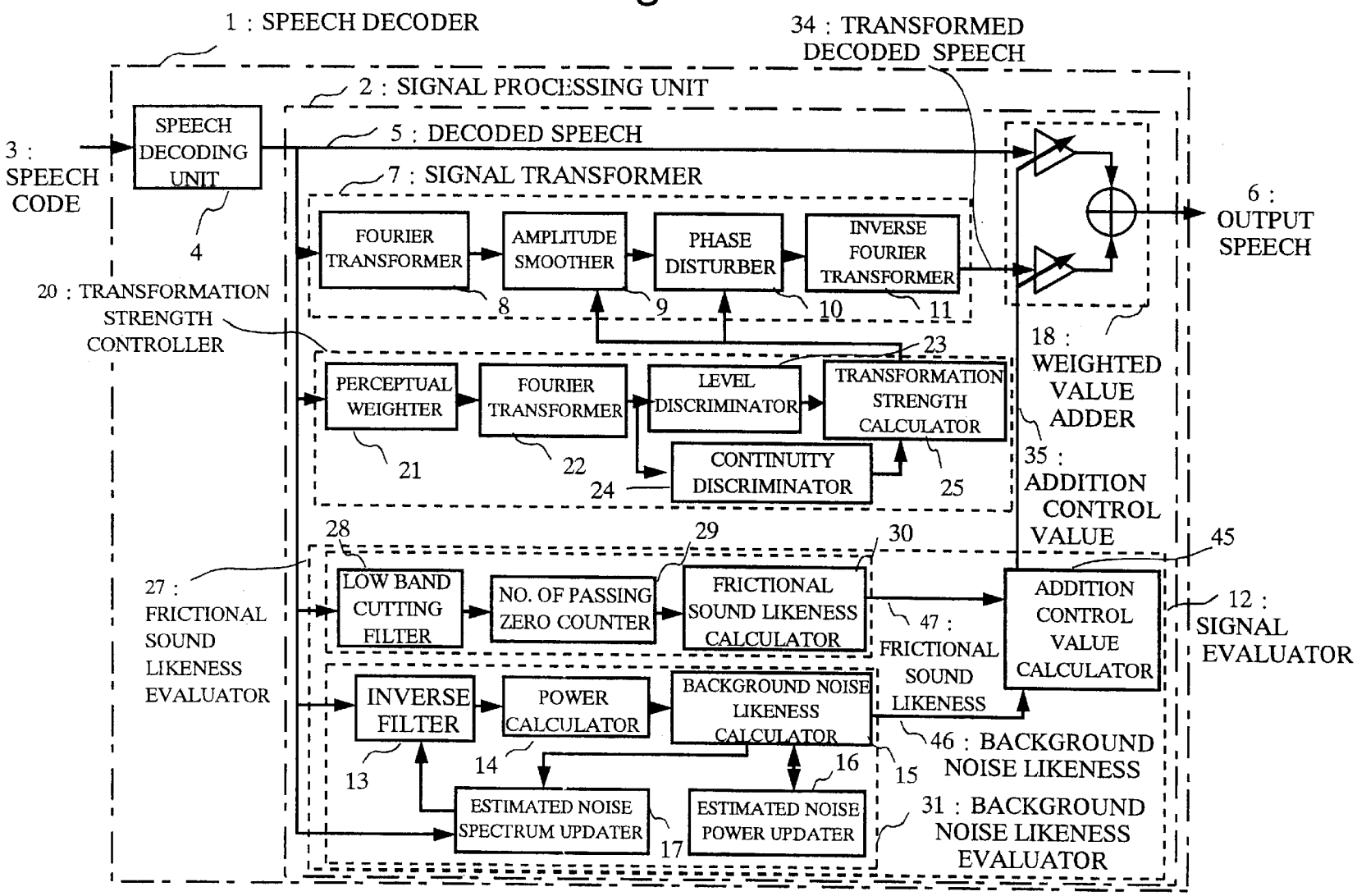
FIG. 9 shows a general configuration of a speech decoding apparatus applying a speech decoding method according to a sixth embodiment of the invention.

FIG. 9 shows a general configuration of the speech decoder applying a sound signal processing method according to the present embodiment, and in FIG. 9, the same reference numerals are assigned to corresponding elements to ones shown in FIG. 5. In the figure, a reference numeral 27 shows a frictional sound likeness evaluator, a reference numeral 31 shows a background noise likeness evaluator, and 45 shows an addition control value calculator. The frictional sound likeness evaluator 27 includes a low band cutting filter 28, a counter 29 for number of passing zero, and a frictional sound likeness calculator 30. The background noise likeness evaluator 31 is configured by the same elements as the signal evaluator 12 shown in FIG. 5, and includes the inverse filter 13, the power calculator 14, the background noise likeness calculator 15, the estimated noise power updater 16, and the estimated noise spectrum updater 17. Different from the configuration shown in FIG. 5, the signal evaluator 12 of FIG. 9 includes the frictional sound likeness evaluator 27, the background noise likeness evaluator 31, and the addition control value calculator 45.

In the following, an operation will be explained referring to the figure.

The decoded speech 5 output from the speech decoding unit 4 is input to each of the signal transformer 7, the transformation strength controller 20 of the signal processing unit 2, and the frictional sound likeness evaluator 27 and the background noise likeness evaluator 31 of the signal evaluator 12, and the weighted value adder 18.

The background noise likeness evaluator 31 of the signal evaluator 12 processes the input decoded speech 5, as well as the signal evaluator 12 of the third embodiment, through the inverse filter 13, the power calculator 14, and the background noise likeness calculator 15. The obtained background noise likeness 46 is output to the addition control value calculator 45. And in the background noise likeness evaluator 31, the estimated noise power updater 16 and the estimated noise spectrum updater 17 also operate and update the estimated noise power and the estimated noise spectrum stored therein, respectively.

The low band cutting filter 28 of the frictional sound likeness evaluator 27 filters the input decoded speech 5 for cutting the low band to suppress the low frequency component, and the filtered decoded speech is output to the number of passing zero counter 29. An object of the process by the low band cutting filter is to prevent the counting result of the number of crossing zero counter 29 from decreasing due to an offset of the direct current component or the low frequency component included in the decoded speech. Therefore, to facilitate the operation, the process by the low band cutting filter can be altered by calculating the mean value of the decoded speeches 5 in the frame and subtracting the obtained value from each sample of the decoded speech 5.

The number of crossing zero counter 29 analyzes the speech input from the low band cutting filter 28, the number of crossing zero is counted, and the counted number of crossing zero is output to the frictional sound likeness calculator 30. As for counting method of the number of crossing zero, the adjacent samples are compared to check their signs. When the signs are not the same, it is detected to have crossed zero and the case is counted. There is another way such that the adjacent samples are multiplied, and if the result is negative number or zero, it is detected to have crossed zero and the case is counted, and so on.

The frictional sound likeness calculator 30 compares the number of crossing zero supplied from the number of crossing zero counter 29 with the predetermined threshold value, obtains the frictional sound likeness 47 based on the compared result, and outputs the obtained value to the addition control value calculator 45. For example, when the number of crossing zero is larger than the threshold value, it is discriminated to be the frictional sound likeness and the frictional sound likeness is set to 1. On the contrary, when the number of crossing zero is smaller than the threshold value, it is discriminated not to be the frictional sound likeness and the frictional sound likeness is set to 0. In another way, more than two threshold values are provided to set the frictional sound likeness gradationally. Further, the frictional sound likeness can be calculated as the value continuous from the number of crossing zero; based on the predetermined function.

The above configuration of the frictional sound likeness evaluator 27 shows only one of examples. The frictional sound likeness evaluator 27 can be configured in various ways: the frictional sound likeness can be evaluated by analyzing result of the spectral incline; evaluated based on the constancy of the power or the spectrum; evaluated by a plurality of parameters including the number of crossing zero.

The addition control value calculator 45 calculates the addition control value 35 based on the background noise likeness 46 supplied from the background noise likeness evaluator 31 and the frictional sound likeness 47 supplied from the frictional sound likeness evaluator 27, and outputs the calculated value to the weighted value adder 18. It may often occur that the quantization noise becomes unpleasant sound in both cases of the background noise likeness and the frictional sound likeness, so that the addition control value 35 is calculated by weighting and adding properly the background noise likeness 46 and the frictional sound likeness 47.

The subsequent operations of the signal transformer 7, the transformation strength controller 20, and the weighted value adder 18 are the same as ones in the third embodiment, and their explanation are omitted.

According to the sixth embodiment, when the input signal (decoded speech) includes high background noise likeness and high frictional sound likeness, the processed signal (transformed decoded speech) is output the input signal (decoded speech), instead. In addition to the effect obtained by the third embodiment, the subjective sound quality can be improved. This is because processing is performed mainly in the frictional sound period, in which the quantization noise or the degraded component frequently occur, and proper processing (not processed, processed in a low level, etc.) is also selected to be performed in the period other than frictional sound period. Other than frictional sound likeness, when a period where the quantization noise or degraded component are tend to occur can be indicated, its likeness is evaluated and it is possible to reflect the evaluated result to the addition control value. By the configuration as described above, the subjective quantity can be further improved by suppressing large quantization noise or degraded component one by one. Another configuration can be implemented, eliminating the background noise likeness evaluator.

Embodiment 7

Figure 10:
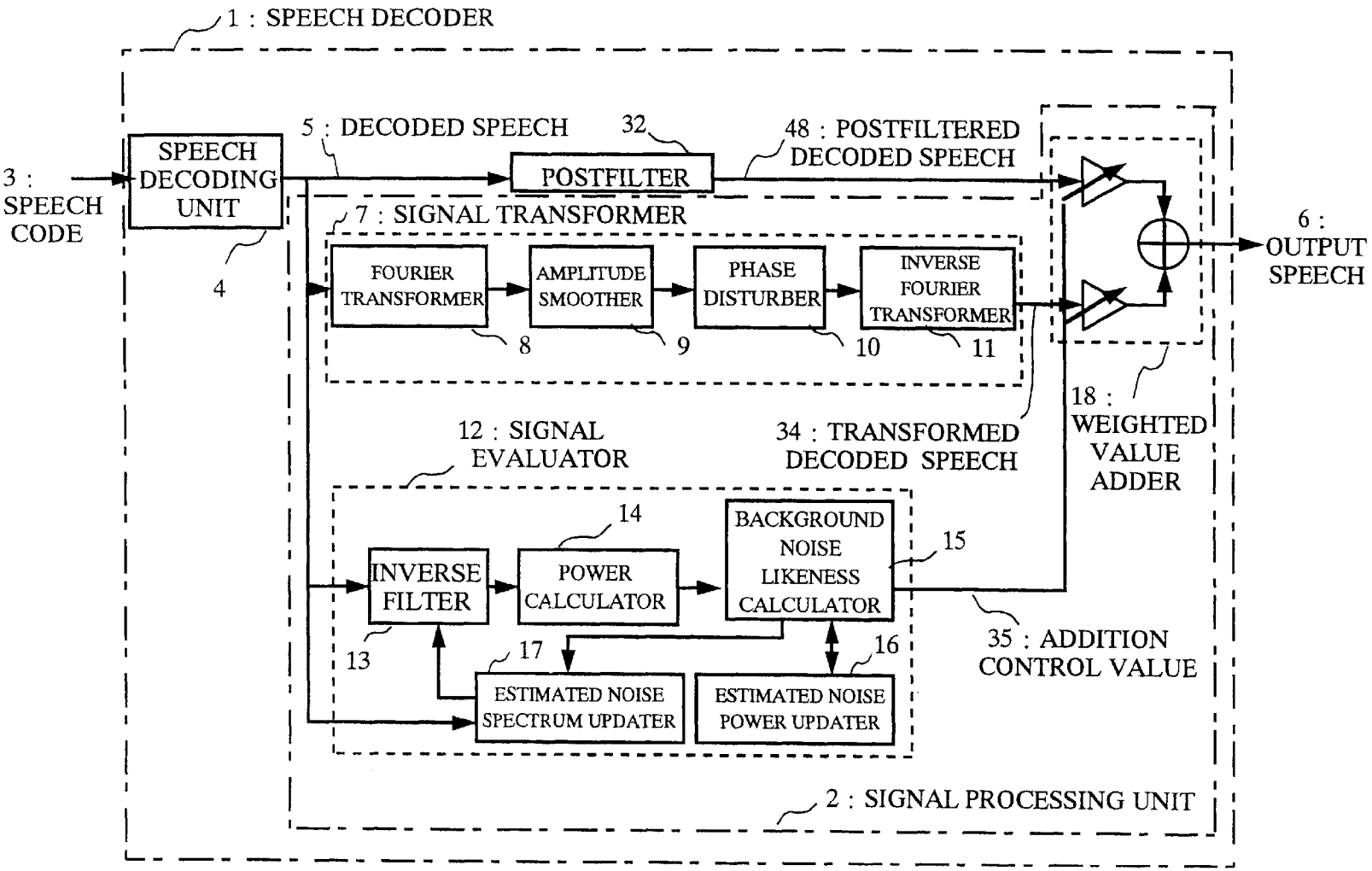
FIG. 10 shows a general configuration of a speech decoding apparatus applying a speech decoding method according to a seventh embodiment of the invention.

FIG. 10 shows a general configuration of a speech decoder applying the signal processing method according to the present embodiment, and in FIG. 10, the same reference numerals are assigned to the corresponding elements to ones shown in FIG. 1. Reference numeral 32 shows a postfilter.

An operation will be explained referring to the figure.

First, the speech code 3 is input to the speech decoding unit 4 of the speech decoder 1.

The speech decoding unit 4 decodes the input speech code 3, and outputs the decoded speech 5 to the postfilter 32, the signal transformer 7 and the signal evaluator 12.

The postfilter 32 performs processing such as spectrum emphasizing processing, or pitch periodicity emphasizing processing on the input decoded speech 5, and outputs the obtained result to the weighted value adder 18 as a postfiltered decoded speech 48. This postfiltering process is generally used as after processing of CELP decoding process, and is aimed to suppress the quatization noise generated by coding/decoding. Since the speech whose spectral strength is weak includes much quantization noise, the amplitude of this component should be suppressed. There are some cases in which pitch periodicity emphasizing processing is omitted and only spectrum emphasizing processing is performed.

In the first, third through sixth embodiments, this prost filtering process has been explained in both cases where the speech decoding unit 4 includes postfiltering process and where postfiltering process is not included. In the seventh embodiment, the independent postfilter 32 performs a part of or whole part of postfiltering process, which is different from the former embodiments where the postfiltering process is included in the speech decoding unit 4.

In the signal transformer 7, the input decoded speech 5 is processed through the Fourier transformer 8, the amplitude smoother 9, the phase disturber 10, the inverse Fourier transformer 11 as well as the first embodiment. The signal transformer 7 outputs the obtained transformed decoded speech 34 to the weighted value adder 18.

The signal evaluator 12 evaluates the background noise likeness of the input decoded speech 5 as well as the first embodiment, and outputs the evaluated result to the weighted value adder 18 as the addition control value 35.

Then, as the final process, the weighted value adder 18 performs the weighted addition of the postfiltered decoded speech 48 supplied from the postfilter 32 and the transformed decoded speech 34 supplied from the signal transformer 7 based on the addition control value 35 supplied from the signal evaluator 12 as well as the first emodiment. The weighted value adder 18 outputs the obtained output speech 6.

According to the seventh embodiment, the transformed decoded speech is generated based on the decoded speech before postfiltering, the background noise likeness is obtained by analyzing the decoded speech before postfiltering, and the weight is controlled for adding the postfiltered decoded speech and the transformed decoded speech based on the obtained background noise likeness. In addition to the effect brought by the first embodiment, the seventh embodiment further improves the subjective quality by generating the transformed decoded speech without including the transformation of the decoded speech due to the postfiltering, and by precisely controlling the weight for addition based on the precise background noise likeness calculated without influence of the transformation of the decoded speech due to the postfiltering.

In the background noise period, the degraded sound has been often emphasized by postfiltering process, which makes the reproduced sound unpleasant to perceive. The distortion sound can be reduced when the transformed decoded speech is generated based on the decoded speech before the postfiltering process. Further, when the postfiltering process includes a plurality of modes, which requires to switch the process frequently, there is high possibility that the evaluation of background noise likeness is influenced by switching. In this case, more stable evaluation result can be obtained when the background noise likeness is evaluated based on the decoded speech before the postfiltering process.

When the postfilter is separated in the configuration of the third embodiment as well as the seventh embodiment, the perceptual weighter 21 shown in FIG. 5 supplies output result closer to the perceptually weighted speech in the encoding process. Accordingly, the specifying precision of the component including much quantization noise is increased, the transformed strength can be controlled properly, and the subjective quality can be further improved.

Further, when the postfilter is separated in the configuration of the sixth embodiment as well as the seventh embodiment, the precision of evaluation is increased in the frictional sound likeness evaluator 27 shown in FIG. 9, which further improves the subjective quality.

When the postfilter is not configured as a separate unit, there is only one connection, that is, the decoded speech, with the speech decoding unit (including a postfilter), which makes easier an operation to be implemented by an independent apparatus or an independent program than the configuration of the seventh embodiment. The seventh embodiment has a disadvantage that to implement a speech decoding operation by an independent apparatus or by an independent program is not easy compared with the speech decoding unit including the postfilter, however, the various effects as described above are provided.

Embodiment 8

Figure 11:
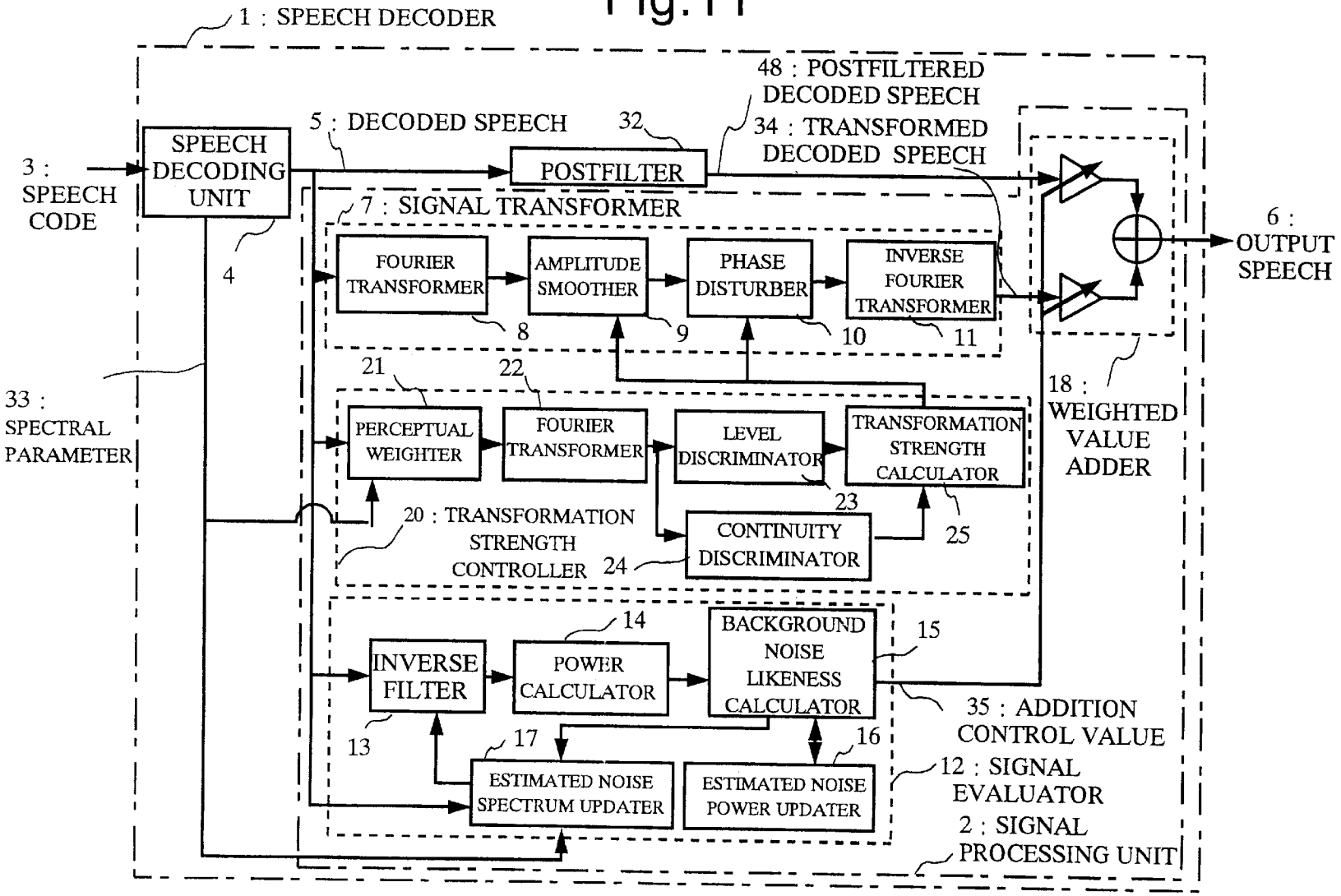
FIG. 11 shows a general configuration of a speech decoding apparatus applying a speech decoding method according to an eighth embodiment of the invention.

In FIG. 11, the same numerals are assigned to corresponding elements to ones shown in FIG. 10. FIG. 11 is a general configuration showing a speech decoder applying the sound signal processing method according to the present embodiment. In the figure, a reference numeral 33 shows a spectral parameter generated in the speech decoding unit 4. Different from the configuration of FIG. 10, the transformation strength controller 20 is added as well as the third embodiment and the spectral parameter 33 is input from the speech decoding unit 4 to the signal evaluator 12 and the transformation strength controller 20.

In the following, an operation will be explained in reference to the drawings.

First, the speech code 3 is input to the speech decoding unit 4 in the speech decoder 1.

The speech decoding unit 4 decodes the input speech code 3, and outputs the decoded speech 5 to the postfilter 32, the signal transformer 7, the transformation strength controller 20, and the signal evaluator 12. Further, the spectral parameter 33 generated in the decoding process is output to the estimated spectrum updater 17 of the signal evaluator 12 and the perceptual weighter 21 of the transformation strength controller 20. In this case, such as linear predictor coefficient (LPC) and line spectrum pair (LSP) are generally used for the spectral parameter 33.

The perceptual weighter 21 of the transformation strength controller 20 perceptually weights the decoded speech 5 supplied from the speech decoding unit 4 using the spectral parameter 33 also supplied from the speech decoding unit 4. The perceptual weighter 21 outputs the perceptually weighted speech to the Fourier transformer 22. As a concrete process, the spectral parameter 33 is used for perceptually weighting without any transformation when the linear predictor coefficient (LPC) is used as the spectral parameter 33. When other than the linear predictor coefficient (LPC) is used as the spectral parameter 33, the spectral parameter 33 is transformed into LPC. By multiplying a constant to the LPC, two kinds of transformed LPC are obtained. An ARMA filter is constructed having these two transformed LPCs as filtering coefficients, and the perceptually weighting is performed by filtering using the ARMA filter. This perceptually weighting process is desired to be the same process as used in the speech encoding process (corresponding process to the speech decoding process performed by the speech decoding unit 4).

In the transformation strength controller 20, subsequent to the process by the perceptual weighter 21, the processing is performed by the Fourier transformer 22, the level discriminator 23, the continuity discriminator 24, and! the transformation strength calculator 25 as well as the third embodiment. The transformation strength obtained by the above processes is output to the signal transformer 7.

In the signal transformer 7, the processing is performed on the input decoded speech 5 and the input transformation strength by the Fourier transformer 8, the amplitude smoother 9, the phase disturber 10, and the inverse Fourier transformer 11 as well as the third embodiment. The signal transformer 7 outputs the transformed decoded speech 34 obtained by the above processes to the weighted value adder 18.

In the signal evaluator 12, the processing is performed on the input decoded speech 5 as well as the first embodiment. The background noise likeness is evaluated by processing with the inverse filter 13, the power calculator 14, and the background noise likeness calculator 15, and the evaluated result is output to the weighted value adder 18 as the addition control value 35. Further, the estimated noise power updater 16 performs the process to update the estimated noise power stored therein.

Then, the estimated noise spectrum updater 17 updates the estimated noise spectrum stored inside of the updater 17 using the spectral parameter 33 supplied from the speech decoding unit 4 and the background noise supplied from the background noise likeness calculator 15. For example, when the input background noise likeness is high, the spectral parameter 33 is reflected to the estimated noise spectrum using to the equation shown in the first embodiment.

The operation s of the postfilter 32 and the weighted value adder18 are the same as ones in the seventh embodiment, and the explanation will be omitted.

According to the eighth embodiment, the perceptually weighting is operated and the estimated noise spectrum is updated using the spectral parameter generated in the speech decoding process. The embodiment brings an effect to simplify the operation in addition to the effect brought by the third and seventh embodiments.

Further, the same perceptually weighting is performed as the same as the encoding process, the precision can be improved in specifying the component including much quantization noise, and better transformation strength control can be obtained, which improves subjective quality.

And, the precision of estimating the estimated noise spectrum for calculating the background noise likeness is improved (from a view point of similarity to the input speech spectrum in the speech encoding process), and consequently, the weight for addition can be controlled precisely based on the stable precise background noise likeness obtained by the above, which improves the subjective quality.

In this eighth embodiment, the postfilter 32 is separated from the speech decoding unit 4. In case the postfilter is not separated, the process of the signal processing unit 2 can be performed using the spectral parameter 33 output from the speech decoding unit 4 as well as the eighth embodiment. In this case, the same effect can be obtained as one in the above eighth embodiment.

Embodiment 9

In the configuration of the fourth embodiment shown in FIG. 7, the addition control value divider 41 can control the transformation strength so that the general spectral form of the transformed decoded speech spectrum 44 multiplied by the weight for each frequency to be added by the weighted value adder 18 is made equal to the form of the estimated quantization noise spectrum.

Figure 12:
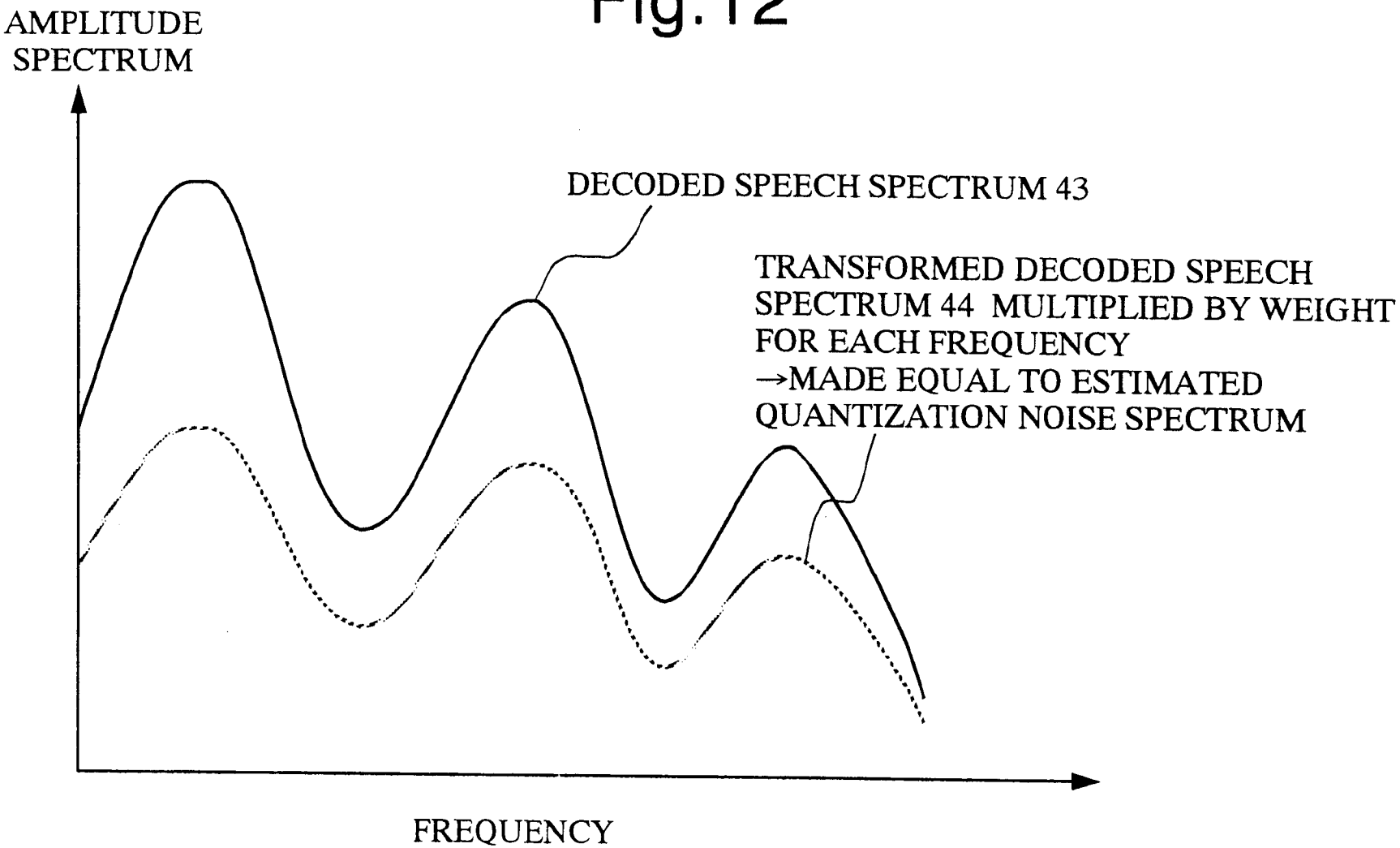
FIG. 12 is a model chart showing an example of spectrum obtained by multiplying a weight for each frequency to a spectrum 43 of the decoded speech and to a spectrum 44 of the transformed decoded speech according to a ninth embodiment of the invention.

FIG. 12 is a model drawing showing examples of the decoded speech spectrum 43 and the transformed decoded speech spectrum 44 multiplied by the weight for each frequency.

In the decoded speech spectrum 43, the quantization noise having a spectral form depending on the encoding method is overlaid. In the speech encoding method of CELP system, the code minimizing the distortion of the perceptually weighted speech is searched. Therefore, the quantization noise of the perceptually weighted speech has a flat spectral form. The spectral form of the final quantization noise has a form with an inverse characteristic of perceptually weighting. Accordingly, the spectral characteristic of the perceptually weighted speech is obtained and the spectral form with the inverse characteristic is obtained. The addition control value divider 41 can control the output so that the transformed decoded speech spectrum has a spectral form matching to the obtained inverse characteristic.

According to the ninth embodiment, the spectral form of the transformed decoded speech component included in the final output speech 6 is made to match to the estimated spectral form of the quantization noise. Accordingly, in addition to the effect of the fourth embodiment, another effect has been brought that unpleasant quantization noise in the speech period is made unperceptible by adding minimum amount of power of the transformed decoded speech.

Embodiment 10

In any configuration of the first embodiment, the third through eighth embodiments, within the process of the amplitude smoother 9, the smoothed amplitude spectrum can be processed so as to have a spectral form matching to the amplitude spectral form of the estimated quantization noise. The amplitude spectral form of the estimated quantization noise can be similarly calculated with the ninth embodiment.

According to the tenth embodiment, the transformed decoded speech is made to have a spectral form matching to the spectral form of the estimated quantization noise. In addition to the effect brought by the first, third through eighth embodiments, another effect has been brought that unpleasant quantization noise in the speech period is made unperceptible by adding minimum amount of power of the transformed decoded speech.

Embodiment 11

In the first, third through tenth embodiments, the signal processing unit 2 is used for processing the decoded speech 5. This signal processing unit 2 can be separated and used for another signal processing such that the signal processing unit 2 is connected after an acoustic signal decoding unit (decoding unit corresponding to an acoustic signal encoding), after the noise suppressing process and so on. In this case, it is necessary to change or control the transformation process of the signal transformer or the evaluation method of the signal evaluator depending on the characteristics of the degraded component to be removed.

According to the eleventh embodiment, it is possible to process the subjectively unpleasant component to become unperceptible in the signal including the degraded component other than the decoded speech.

Embodiment 12

In the above first through eleventh embodiments, the signal up to the present frame is used for processing. Another configuration can be made, in which the processing delay can be approved to use the signal from the subsequent frame on.

According to the twelfth embodiment, the signal from the subsequent frame on can be referred, which brings an effect improving smoothing characteristics of the amplitude spectrum, increasing the precision of discriminating the continuity, increasing the precision of evaluating background noise likeness and so on.

Embodiment 13

In the above first, third, fifth through twelfth embodiment, the spectral component is calculated by the Fourier transformation, the transformation is performed and the transformed spectral component is returned to the signal region by the inverse Fourier transformation. Instead of the Fourier transformation, transformation is performed on each output of band-pas filtering group and the signal can be reproduced by adding the signal of each band.

According to the thirteenth embodiment, the same effect can be brought by the configuration without using the Fourier transformer.

Embodiment 14

In the above first through thirteenth embodiments, the speech decoder includes both of the amplitude smoother 9 and the phase disturber 10. The speech decoder can be configured without either of the amplitude smoother 9 and the phase disturber 10, or can be configured including another kind of unit for transformation.

According to the fourteenth embodiment, the processing can be simplified by removing the unit for transformation which brings little effect depending on the characteristics of the quantization noise or the degraded sound desired to be eliminated. Further, it can be expected to eliminate the quantization noise or the degraded sound which cannot be eliminated by the amplitude smoother 9 and the phase disturber 10 by including a proper kind of unit for transformation.

INDUSTRIAL APPLICABILITY

As has been described, according to the method and the apparatus for processing sound signal of the present invention, a predetermined signal processing is performed on the input signal so as to generate a processed signal in which the degraded component of the input signal is made subjectively unperceptible. The weights for adding to the input signal and the processed signal are controlled by a predetermined evaluation value. A ratio of the processed signal is increased predominantly in the period including much amount of the degraded component, which enables to improve subjective quality.

Further, the conventional binary value discrimination of the period is excluded and the evaluation value of the continuity is calculated. Based on this, the weighted addition coefficient for adding the input signal and the processed signal can be controlled continuously, which overcome the degradation of the quality due to misjudge of the period.

Further, the output signal can be generated by processing the input signal including much information of the background noise. The present invention improves the quality of the reproduced sound being stable and without much depending on the kind of noise or spectral form while the characteristic of the actual background noise remains, and also improves the quality on decoding the degraded component due to encoding the acoustic source and so on.

Further, the processing can be performed using the input signal up to the present frame, so that a large amount of delay time is not required. The delay time other than the processing time can be eliminated depending on the method for adding the input signal and the processed signal. When the level of processed signal is increased, the level of input signal is made decreased. By operating as described above, it is not necessary to overlay much pseudo noise for masking the degraded component as in the conventional way. On the contrary, the background noise level can be decreased or increased according to the signal to be processed. Of course, it is not necessary to add new information for transmission as done in the conventional way even when the degraded sound due to the encoding/decoding the speech is to be eliminated.

According to the method and the apparatus for processing the sound signal of the present invention, a predetermined process is performed on the input signal within the spectral region. The degraded component included in the input signal is processed to become subjectively unperceptible, and the weights for adding to the input signal and the processed signal are controlled based on the predetermined evaluation value. Accordingly, in addition to the above effect of the signal processing method, the degraded component in the spectral region can be suppressed precisely, which further improves the subjective quality.

According to the present invention, the input signal and the processed signal are weighted and added in the spectral region in the above sound processing method of the invention. Accordingly, in addition to the above effect of the sound signal processing method, when the signal processing in the spectral region is connected as a subsequent stage of the noise suppressing process, a part of or all processes required for the sound signal processing method such as Fourier transformation and inverse Fourier transformation can be removed, which facilitates the processing.

According to the present invention, the weighted addition is controlled respectively for each frequency component in the above sound signal processing method of the invention. Therefore, in addition to the above effect of the sound signal processing method, a dominant component of the quantization noise or the degraded component is mainly converted by the processed signal. Accordingly, the case in which a good component including small amount of the quantization noise or the degraded component is converted can be avoided. The characteristics of the input signal can be remained properly and the quantization noise and the degraded component can be subjectively suppressed, which improves the subjective quality.

According to the present invention, the amplitude spectral component is smoothed as a processing in the above sound signal processing method of the invention. Therefore, in addition to the above effect of the sound signal processing method, the unstable variation of the amplitude spectral component generated due to the quantization noise can be suppressed properly, which improves the subjective quality.

According to the present invention, the phase spectral component is disturbed as a processing in the above sound signal processing method of the invention. Therefore, in addition to the above effect of the sound signal processing method, the relationship between the phase components of the quantization noise or the degraded component, which tends to be a particular correlation to cause a characteristic degradation, can be disturbed to improve the subjective quality.

According to the present invention, the smoothing strength or the disturbing strength is controlled based on the amplitude spectral component of the input signal or the weighted input signal in the above sound signal processing method of the invention. Therefore, in addition to the above effect of the sound signal processing method, the component in which the quantization noise or the degraded component is dominant because the amplitude spectral component is small is mainly processed. Accordingly, the case in which a good component including small amount of the quantization noise or the degraded component is converted can be avoided. The characteristics of the input signal can be remained properly and the quantization noise and the degraded component can be subjectively suppressed, which improves the subjective quality.

According to the present invention, the smoothing strength or the disturbing strength is controlled based on the time-based continuity of the spectral component of the input signal or the perceptually weighted input signal in the above sound signal processing method of the invention. Therefore, in addition to the above effect of the sound signal processing method, the component in which the quantization noise or the degraded component tend to be large because the continuity of the spectral component is low is mainly processed. Accordingly, the case in which a good component including small amount of the quantization noise or the degraded component is processed can be avoided. The characteristics of the input signal can be remained properly and the quantization noise and the degraded component can be subjectively suppressed, which improves the subjective quality.

According to the present invention, the smoothing strength or the disturbing strength is controlled based on the time variation of the evaluation value in the above sound signal processing method of the invention. Therefore, in addition to the above effect of the sound signal processing method, the case in which unnecessary strong processing is performed in the period where the characteristics of the input signal varies can be avoided. Especially, the generation of laziness and echo due to smoothing the amplitude can be avoided.

According to the present invention, an extent of the background noise likeness is used for the predetermined evaluation value in the above sound signal processing method of the invention. Therefore, in addition to the above effect of the sound processing method, the background noise period in which the quantization noise or the degraded component tends to frequently occur is mainly processed. Further, a proper processing (e.g., not processed, processed in a low level) can be selected for the period other than the background noise period, which improves the subjective quality.

According to the present invention, an extent of the frictional sound likeness is used for the predetermined evaluation value in the above sound signal processing method of the invention. Therefore, in addition to the above effect of the sound processing method, the frictional sound period in which the quantization noise or the degraded component tends to frequently occur is mainly processed. Further, a proper processing (e.g., not processed, processed in a low level) can be selected for the period other than the frictional sound period, which improves the subjective quality.

According to the sound signal processing method of the present invention, the speech code generated by the speech encoding process is input, and the input speech code is decoded to generate the decoded speech. The decoded speech is input and processed using the sound processing method to generate the processed speech, and the processed speech is output as an output speech. Therefore, the decoded speech having the same effect of improving the subjective quality as the above sound signal processing method can be obtained.

According to the sound signal processing method of the present invention, the speech code generated by the speech encoding process is input, and the input speech code is decoded to generate the decoded speech. The decoded speech is input and processed using the predetermined signal processing to generate the processed speech, and postfiltering is performed on the decoded speech. The predetermined evaluation value is calculated by analyzing the decoded speech before postfiltering or after postfiltering, the weighted addition is performed on the postfiltered decoded speech and the processed speech, and the obtained result is output. Therefore, the decoded speech having the same effect of improving the subjective quality as the above sound signal processing method can be obtained, and in addition, the processed speech without postfiltering influence can be generated, the weight for addition can be precisely controlled based on the precise evaluation value calculated without the postfiltering influence, which further improves the subjective quality.

What is claimed is:

1. A method for processing a sound signal comprising:

generating a first processed signal by processing an input sound signal;

calculating a predetermined evaluation value by analyzing the input sound signal;

operating a weighted addition of the input sound signal and the first processed signal based on the predetermined evaluation value to generate a second processed signal; and outputting the second processed signal.

2. The method for processing the sound signal according to claim 1, wherein the step of generating the first processed signal further comprises:

calculating a spectral component for each frequency by performing a Fourier transformation on the input sound signal;

performing a predetermined transformation on the spectral component for each frequency calculated by performing the Fourier transformation; and generating the first processing signal by performing an inverse Fourier transformation on the spectral component after the predetermined transformation.

3. The method for processing the sound signal according to claim 2, wherein the predetermined transformation on the spectral component for each frequency includes a smoothing process of an amplitude spectral component.

4. The method for processing the sound signal according to claim 3, wherein the smoothing process controls smoothing strength based on an extent of the amplitude spectral component of the input sound signal.

5. The method for processing the sound signal according to claim 4, wherein a perceptually weighted input sound signal is used for the input sound signal.

6. The method for processing the sound signal according to claim 3, wherein the smoothing process controls smoothing strength based on an extent of time-based continuity of the spectral component of the input sound signal.

7. The method for processing the sound signal according to claim 3, wherein the smoothing process controls smoothing strength based on an extent of variability in time of the evaluation value.

8. The method for processing the sound signal according to claim 2, wherein the predetermined transformation on the spectral component for each frequency includes a disturbing process of a phase spectral component.

9. The method for processing the sound signal according to claim 8, wherein the disturbing process controls disturbing strength based on an extent of an amplitude spectral component of the input sound signal.

10. The method for processing the sound signal according to claim 8, wherein the disturbing process controls disturbing strength based on an extent of time-based continuity of the spectral component of the input sound signal.

11. The method for processing the sound signal according to claim 8, wherein the disturbing process controls disturbing strength based on an extent of variability in time of the evaluation value.

12. The method for processing the sound signal according to claim 1, wherein the weighted addition is operated in a spectral region.

13. The method for processing the sound signal according to claim 12, wherein the weighted addition is controlled respectively for each frequency component.

14. The method for processing the sound signal according to claim 1, wherein an extent of a background noise likeness calculated by analyzing the input sound signal is used for the predetermined evaluation value.

15. The method for processing the sound signal according to claim 1, wherein an extent of a frictional noise likeness calculated by analyzing the input sound signal is used for the predetermined evaluation value.

16. The method for processing the sound signal according to claim 1, wherein a decoded speech decoded from a speech code generated by a speech encoding process is used for the input sound signal.

17. A method for processing a sound signal comprising:

decoding a speech code generated by a speech encoding process as an input sound signal to obtain a first decoded speech;

generating a second decoded speech by postfiltering the first decoded speech;

generating a first processed speech by processing the first decoded speech;

calculating a predetermined evaluation value by analyzing any of the decoded speeches;

operating weighted addition of the second decoded speech and the first processed speech based on the evaluation value to obtain a second processed speech; and outputting the second processed speech as an output speech.

18. An apparatus for processing a sound signal comprising:

a first processed signal generator processing an input sound signal to generate a first processed signal;

an evaluation value calculator calculating a predetermined evaluation value by analyzing the input sound signal;

a second processed signal generator operating a weighted addition of the input sound signal and the first processed signal based on the evaluation value calculated by the evaluation value calculator and outputting a result of the weighted addition as a second processed signal.

19. The apparatus for processing the sound signal according to claim 18, wherein the first processed signal generator calculates a spectral component for each frequency by operating a Fourier transformation of the input sound signal, smoothes an amplitude spectral component included in the spectral component calculated for each frequency, and generates the first processed signal by operating an inverse Fourier transformation of the spectral component after smoothing the amplitude spectral component.

20. The apparatus for processing the sound signal according to claim 18, wherein the first processed signal generator calculates a spectral component for each frequency by operating a Fourier transformation of the input sound signal, disturbs a phase spectral component included in the spectral component calculated for each frequency, and generates the first processed signal by operating an inverse Fourier transformation of the spectral component after disturbing the phase spectral component.

* * * * *